US007718338B2

(12) United States Patent
Fujimoto et al.

(10) Patent No.: US 7,718,338 B2
(45) Date of Patent: May 18, 2010

(54) CHARGE CONTROL RESIN, AND TONER

(75) Inventors: Norikazu Fujimoto, Susono (JP); Yasukazu Ayaki, Yokohama (JP); Shigeto Tamura, Suntoh-gun (JP); Tetsuya Yano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 435 days.

(21) Appl. No.: 11/575,724

(22) PCT Filed: Mar. 24, 2006

(86) PCT No.: PCT/JP2006/306781

§ 371 (c)(1),
(2), (4) Date: Mar. 21, 2007

(87) PCT Pub. No.: WO2006/104224

PCT Pub. Date: Oct. 5, 2006

(65) Prior Publication Data

US 2008/0118854 A1 May 22, 2008

(30) Foreign Application Priority Data

Mar. 29, 2005 (JP) ..... 2005-094567

(51) Int. Cl.
*G03G 9/08* (2006.01)

(52) U.S. Cl. ..... 430/108.22; 526/287; 526/303.1; 526/307.4

(58) Field of Classification Search ..... 430/108.22; 526/287, 303.1, 307.4
See application file for complete search history.

(56) References Cited

U.S. PATENT DOCUMENTS

| | | | | |
|---|---|---|---|---|
| 4,797,339 | A | 1/1989 | Maruyama et al. | 430/109 |
| 4,957,840 | A | 9/1990 | Sakashita et al. | 430/106.6 |
| 4,996,127 | A | 2/1991 | Hasegawa et al. | 430/109 |
| 5,014,089 | A | 5/1991 | Sakashita et al. | 355/251 |
| 5,137,796 | A | 8/1992 | Takiguchi et al. | 430/106.6 |
| 5,212,033 | A * | 5/1993 | Tsubota et al. | 430/108.22 |
| 5,216,098 | A * | 6/1993 | Ahmed et al. | 526/287 |
| 5,262,267 | A | 11/1993 | Takiguchi et al. | 430/122 |
| 5,310,615 | A | 5/1994 | Tanikawa | 430/106.6 |
| 5,594,083 | A * | 1/1997 | Funk et al. | 526/287 |
| 5,597,673 | A * | 1/1997 | Watanabe et al. | 430/96 |
| 5,721,433 | A | 2/1998 | Kosaka | 250/573 |
| 5,741,617 | A | 4/1998 | Inaba et al. | 430/110 |
| 5,798,199 | A * | 8/1998 | Bilbrey et al. | 430/108.22 |
| 6,124,070 | A | 9/2000 | Baba et al. | 430/109 |
| 6,342,328 | B1 * | 1/2002 | Takasaki et al. | 430/108.22 |
| 6,475,685 | B2 | 11/2002 | Uchida et al. | 430/99 |
| 7,252,917 | B2 | 8/2007 | Ohno et al. | 430/108.24 |
| 2002/0049280 | A1 * | 4/2002 | Westerman | 526/287 |
| 2002/0103291 | A1 * | 8/2002 | Westerman | 526/287 |
| 2003/0191263 | A1 * | 10/2003 | Yoshida et al. | 526/303.1 |
| 2005/0182219 | A1 * | 8/2005 | Meyer et al. | 526/303.1 |
| 2005/0287463 | A1 | 12/2005 | Fukui et al. | 430/111.35 |
| 2006/0035098 | A1 | 2/2006 | Fukui et al. | 428/522 |
| 2007/0059627 | A1 | 3/2007 | Fukui et al. | 430/110.3 |
| 2007/0111125 | A1 | 5/2007 | Tominaga et al. | 430/108.1 |
| 2007/0117945 | A1 | 5/2007 | Minami et al. | 526/348 |

FOREIGN PATENT DOCUMENTS

| | | |
|---|---|---|
| JP | 36-10231 | 7/1961 |
| JP | 59-053856 | 3/1984 |
| JP | 59-061842 | 4/1984 |
| JP | 62-106473 | 5/1987 |
| JP | 63-186253 | 8/1988 |
| JP | 1-112253 | 4/1989 |
| JP | 1-191156 | 8/1989 |
| JP | 2-214156 | 8/1990 |
| JP | 2-284158 | 11/1990 |
| JP | 03-015858 | 1/1991 |
| JP | 03-036974 | 2/1991 |
| JP | 03-056974 | 3/1991 |
| JP | 3-181952 | 8/1991 |
| JP | 4-162048 | 6/1992 |
| JP | 8-012467 | 2/1996 |
| JP | 08-030017 | 2/1996 |
| JP | 8-050367 | 2/1996 |
| JP | 8-136439 | 5/1996 |
| JP | 2807795 | 7/1998 |
| JP | 11-184165 | 7/1999 |
| JP | 11-288129 | 10/1999 |
| JP | 2000-056518 | 2/2000 |
| JP | 2001-318484 | 11/2001 |

* cited by examiner

*Primary Examiner*—Christopher RoDee
(74) *Attorney, Agent, or Firm*—Fitzpatrick, Cella, Harper & Scinto

(57) ABSTRACT

A charge control resin containing a copolymer which has a unit having a sulfonic acid ester group having a specific structure and has the unit in specific proportions. The charge control resin can provide a toner with superior charging performance. Also disclosed is a toner having such a charge control resin.

26 Claims, No Drawings

CHARGE CONTROL RESIN, AND TONER

TECHNICAL FIELD

This invention relates to a charge control resin contained in a toner for developing electrostatic latent images in image forming processes such as electrophotography, electrostatic printing and so forth or a toner for forming toner images in an image forming process of a toner jet system. This invention also relates to a toner containing such a charge control resin. More particularly, it relates to a toner used in a fixing system in which toner images are fixed by heat and pressure to a transfer material such as a print sheet.

BACKGROUND ART

Conventionally, in image forming processes carried out by electrophotography, electrostatic printing and so forth, the system is so set up that toner particles charged electrostatically develop electrostatic latent images on a photosensitive drum by the aid of an electrostatic force corresponding to potential differences produced on the photosensitive drum. Here, the toner is electrostatically charged by, stated specifically, the friction between toner particles themselves, between the toner and a carrier and further between the toner and a toner layer thickness control blade and so forth. Hence, it is essential to control, besides the particle diameter and particle size distribution of the toner, the charging performance (or chargeability) of the toner.

In order to control the charging performance of the toner, the triboelectric charge characteristics of a binder resin itself may be utilized. However, many binder resins used commonly in toners have low triboelectric charge characteristics, and it is not easy to control the charging performance by controlling their composition. Accordingly, it is common to add what is called a charge control agent capable of imparting charging performance to toners.

Conventionally, as negative-charging charge control agents, available are metal complex salts of monoazo dyes, metal compounds of nitrofumic acid and salts thereof, salicylic acid, alkylsalicylic acids, dialkylsalicylic acids, naphthoic acid, dicarboxylic acids and so forth, boron compounds, urea compounds, silicon compounds, carixarene, sulfonated copper phthalocyanine pigments, chlorinated paraffin, and so forth. Charge control agents containing these dyes or pigments are structurally complicated, are not constant in properties and have a poor stability. In particular, almost all of them cause changes in charging performance depending on environmental factors such as temperature and humidity. Also, some agents change in nature because of decomposition or the like at the time of heat kneading.

In addition, these charge control agents added to toners must be present on toner surfaces to a certain extent in order to impart triboelectric chargeability to the toners. Hence, such an additive may come off toner surfaces because of friction between toners themselves, their collision with a carrier, their friction with a transport sleeve or roller, a toner layer thickness control blade and a photosensitive drum to cause contamination of the carrier and so forth and contamination of developing members and the photosensitive drum. As the result, with an increase in the number of sheets during running, the charging performance becomes poor and at the same time any deterioration due to contamination also becomes worse to cause problems such as changes in image density and a lowering of image quality.

As stated above, charge control agents capable of imparting a sufficient charging performance to toners stably over a long period of time are seen to be very limited. Also, in order for them to be used in full-color toners, those to be added to the toners may preferably be colorless, and further, in order for them to be used in polymerization toners, may preferably have no polymerization inhibitory action. Therefore, taking account of these, only very few agents are feasible for practical use.

As the step of fixing toner images, it has been put forward to use, e.g., a pressure contact heating method making use of a heating roller (hereinafter "heating roller fixing method"), and a heat fixing method in which toner images are fixed bringing a fixing medium sheet into close contact with a heating element through a fixing film (hereinafter "film fixing method").

In the heating roller or film fixing method, toner images held on the fixing medium sheet are made to pass the surface of the heating roller or fixing film while bringing the former into contact with the latter under application of pressure by means of a pressure member kept in touch with the latter. In this fixing method, since the surface of the heating roller or fixing film and the toner images held on the fixing medium sheet come into contact with each other under application of pressure, the heat efficiency in fusing the toner images onto the sheet is so high as to enable performance of rapid and good fixing.

In circumstances where electrophotographic apparatus used in recent years are variously demanded to be achievable of high image quality and to be made compact and lightweight, high-speed and high-productivity, energy-savable, highly reliable, low-cost, maintenance-free and so forth, it is an important technical subject how systems and materials are put forward which can achieve much higher speed, energy saving, high reliability and so forth, especially in the step of fixing. However, in order to resolve such a subject in the heating roller or film fixing method, it is essential, in particular, to vastly improve fixing performance of the toner that is a material. Thus, it is necessary to improve the performance of being capable of sufficient fixing to the fixing medium sheet at a lower temperature (hereinafter "low-temperature fixing performance") and to improve the performance of being capable of prevention of offset which is a phenomenon in which contamination due to toner having adhered to the surface of the heating roller or film causes contamination of a next fixing medium sheet (hereinafter "anti-offset performance").

In toners to be fixed by heat and pressure, toners incorporated with a wax having a high affinity for binder resins exhibits good anti-offset performance and low-temperature fixing performance under specific fixing conditions (see, e.g., Japanese Patent Application Laid-open Nos. H08-050367 and 2001-318484). In these toners, however, glass transition point of toner and melt viscosity of toner may lower as the wax blends with the binder resin, and hence, besides storage stability and fluidity, the charging performance tends to be damaged when it is aimed to further improve the low-temperature fixing performance, to tend to cause a great decrease in density and image defects especially when printed continuously. Accordingly, it is sought to provide a toner satisfying development stabilizing performance in virtue of superior charging performance and having further low-temperature fixing performance.

Now, as printers, LED or laser beam printers are prevalent in recent market, and techniques trend toward those having a higher resolution, that is, those which hitherto have a resolution of 300 or 400 dpi are being replaced by those having a resolution of 600 or 1,200 dpi. Accordingly, correspondingly thereto, developing systems have also come to be required to secure a higher minuteness. Also, in copying machines as well, they are being made more high-function, and hence are trending toward digital processing. This trend is chiefly a trend toward a method in which electrostatic latent images are formed using a laser, and hence the copying machines are also trending toward high resolution. Here is also demanded a high-resolution and high-minuteness developing system like the printers. As a means for meeting such a demand, toners are being made to have a smaller particle diameter, and toners with a small particle diameter and having specific particle size distribution are proposed (see, e.g., Japanese Patent Applications Laid-open No. H01-112253, No. H01-191156, No. H02-214156, No. H02-284158, No. H03-181952 and No. H04-162048).

However, as toners have smaller particle diameter, stable triboelectric charging of toner powder becomes an important technique. More specifically, the lowering of image stability as stated above tends to occur more remarkably unless fine individual toner particles are made to have a uniform charge quantity. This is because, as the toner merely has a small particle diameter, the toner particles adhere to the photosensitive member at a larger force (image force or van der Waals force) than Coulomb force acting on toner particles in the step of transfer, and, in addition thereto, since making toners have smaller particle diameter concurrently makes the toner have poor fluidity, the toner particles tend to have non-uniform charge quantity, so that toner particles causative of fog and having poor transfer performance may come present in a large number.

From the background as stated above, studies are energetically made on how toners can be improved in charge characteristics. In particular, on account of consideration for environment, requirement for stabler charging performance and reduction of production cost, it is proposed in recent years that a resin having a charge control function is used as a raw material for toners (see, e.g., Japanese Patent Publication No. H08-012467 and Japanese Patent No. 2663016).

According to what are disclosed in these publications, toners improved in charging performance are obtainable. However, as a result of studies made by the present inventors on these toners, it has turned out that they have a problem that, when printed on a large number of sheets, a toner charged to a reverse polarity increases gradually in a developing assembly to make what is called reversal fog rapidly come to occur seriously. Also, in these publications, disclosed is only a binary copolymer composed of styrene and 2-acrylamido-2-methylpropane sulfonic acid, and the binary copolymer disclosed therein has a glass transfer material temperature of 90° C. or more, and has caused a problem on the low-temperature fixing performance in some cases.

Toners containing a copolymer of a more improved, sulfonic acid group-containing acrylamide and a vinyl monomer (see, e.g., Japanese Patent Applications Laid-open No. H11-184165, No. H11-288129 and No. 2000-056518). However, in these publications as well, the achievement of both charging performance (in particular, rise performance at the initial stage) and fixing performance can not be well satisfactory.

In regard to the improvement in charging performance of the resin having a charge control function, too, some proposals are hitherto made (see, e.g., Japanese Patent No. 2807795 and Japanese Patent Application Laid-open No. H08-030017). According to what are disclosed in these publications, toners are obtainable which have a relatively good rise of charging and in which various additives are well stand dispersed in the binder resin. In regard to the charging performance, however, there is further room for improvement, and also these toners can not be said to be sufficient in regard to the low-temperature fixing performance as well. Further, in the toners disclosed in these publications, their transfer performance is not sufficient to cause problems on image quality in some cases.

DISCLOSURE OF THE INVENTION

The present invention has been made taking account of the foregoing problems.

Accordingly, an object of the present invention is to provide a charge control resin having a superior charging performance.

Another object of the present invention is to provide a toner having a good fixing performance, which is also a toner which has superior charge characteristics, can retain stable developing performance and transfer performance from the initial stage up to after many-sheet printing, and can give stable images over a long period of time.

That is, the present invention provides the following charge control resin.

A charge control resin containing a copolymer which has, as at least partial structures thereof, all units represented by the following formulas (1) to (3);

in the copolymer, the total content of the units represented by the following formulas (1) and (2) being, on the basis of the number of units, in a proportion of:

Units represented by the following formulas (1) and (2):other unit(s)=3:97 to 15:85; and in the copolymer, the content of the unit represented by the following formula (1) and that of the unit represented by the following formula (2) being, on the basis of the number of units, in a proportion of:

Unit represented by the following formula (1):unit represented by the following formula (2)=50:50 to 95:5:

(1)

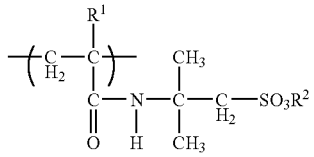

wherein $R^1$ represents a hydrogen atom, a methyl group or an ethyl group; and $R^2$ represents an alkyl group having 1 to 4 carbon atoms;

(2)

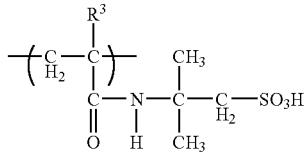

wherein $R^3$ represents a hydrogen atom, a methyl group or an ethyl group; and (3)

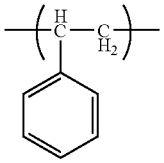

The present invention also provides a toner which has toner particles containing at least a binder resin, a colorant and the charge control resin described above.

BEST MODES FOR CARRYING OUT THE INVENTION

The use of a toner characterized by the present invention as detailed below makes it possible to achieve a good low-temperature fixing performance and a stable triboelectric charging performance, and consequently to obtain images which are stable over a long period of time, securing good developing performance and transfer performance.

The present inventors have made extensive studies on the fixing performance, charging stability, developing and transfer performance and so forth of toners. As a result, they have discovered that, even in a toner containing a wax and having a good fixing performance, a toner having stable charge characteristics and a good developing performance can be obtained by using a charge control resin containing a copolymer which has, as at least partial structures thereof, units represented by the following formulas (1) to (3) (hereinafter also simply "copolymer"):

(1)

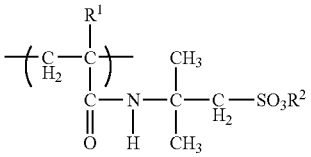

wherein $R^1$ represents a hydrogen atom, a methyl group or an ethyl group; and $R^2$ represents an alkyl group having 1 to 4 carbon atoms;

(2)

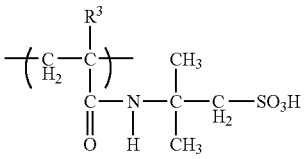

wherein $R^3$ represents a hydrogen atom, a methyl group or an ethyl group; and (3)

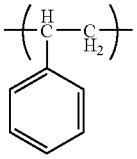

What is most characteristic of the above copolymer is that it has an $SO_3R^2$ group. That is, in respect of a resin having only a sulfonic acid group as proposed conventionally, part of the sulfonic acid group is esterified so as to enable improvement of its charging come-out effect. As the result, the toner containing this resin has superior rise performance in triboelectric charging from the initial stage. The reason therefor is unclear, and is presumed to be that such a sulfonic acid ester group has a higher hydrophobicity than the sulfonic acid group and hence its electron withdrawing properties act without being affected by water molecules present in the air. It is also considered that the sulfonic acid ester group differs in triboelectric mechanism at a molecular level, from an anionic state as in a sulfonic acid salt. Its influence on the value of electrical resistance of the surfaces of toner obtained is also not negligible. Further, it has turned out that, in toners produced by a production process having the is step of granulation in an aqueous medium, the granulation is more affected with an increase in content of the sulfonic acid group or sulfonic acid salt group, to bring about a case in which its content in toner is restricted, whereas the introduction of the sulfonic acid ester group makes the granulation vastly less affected. Also, on the other hand, if all sulfonic acid groups have been formed into sulfonic acid ester groups, the copolymer comes present in a small quantity in the vicinity of toner particle surfaces, and hence it is preferable that the sulfonic acid group and the sulfonic acid ester group are present together in a specific proportion.

In addition, what is also characteristic of the above copolymer is that it has a styrene unit, the unit represented by the formula (3). Where the copolymer as described above is localized in the vicinity of toner particle surfaces, there is a possibility that, if the copolymer has a low glass transition point, the toner may have a poor storage stability to cause a blocking phenomenon, and, especially in a high-temperature environment, to cause melt adhesion of toner to the interior of a developing assembly and to developing members, and further toner particles may melt-adhere to one another to cause a lowering of their fluidity. Also, it is essential to control the compatibility of the copolymer with the binder resin. As a result of extensive studies made by the present inventors, they have discovered that the presence of the styrene unit enables control of the compatibility of the copolymer with the binder resin, without inhibiting the charging come-out effect to be brought by the sulfonic acid ester unit which is the unit represented by the formula (1), and the sulfonic acid unit which is the unit represented by the formula (2), and moreover enables the glass transition point of the resin to be designed within a preferable range. In addition, the presence of the styrene unit makes it easy to control molecular weight while retaining random copolymerization properties, to enable sulfonic acid ester units to be prevented from coming distributed non-uniformly in the molecule. For the reasons as stated above, the charge characteristics can be made stable without damaging the fixing performance of the toner to be consequently obtained.

The proportion of the content of the sulfonic acid ester unit and that of the sulfonic acid unit in the copolymer is described next. In the present invention, the sulfonic acid ester unit and the sulfonic acid unit are contained in total, on the basis of the number of units (molar basis), in a proportion of:

sulfonic acid ester unit and sulfonic acid unit:other unit(s)=3:97 to 15:85, and preferably 5:95 to 12:88, based on other unit(s) that form(s) the copolymer.

If the total content of the sulfonic acid ester unit and sulfonic acid unit is too small, the toner may have an insufficient charging performance. If on the other hand it is too large, the toner may have a low developing and transfer performance. Incidentally, in the present invention, the "unit" refers to a constitutional unit due to a monomer used in the polymerization for the copolymer and constituting the copolymer.

In the above copolymer, the content of the sulfonic acid ester unit and that of the sulfonic acid unit are, on the basis of the number of units, in a proportion of:

sulfonic acid ester unit:sulfonic acid unit=50:50 to 95:5, and preferably 65:35 to 90:10.

If the proportion of the sulfonic acid ester group is smaller than 50:50, the toner tends to have inferior charge characteristics at the initial stage. If the proportion of the sulfonic acid ester group is larger than 90:5, sulfonic acid ester groups tend to be less present, or be localized, in the vicinity of toner surfaces. Hence, it is preferable that the sulfonic acid group and the sulfonic acid ester group are present together in the above specific proportion.

Furthermore, if the proportion of the styrene unit is too small, it may be difficult to control molecular weight while retaining random copolymerization properties, to cause non-uniform distribution of sulfonic acid ester units in the molecule. Also, the copolymer may have a low Tg (glass transition point) or the toner may have low storage stability and running stability, and, in addition thereto, the copolymer has so greatly a poor compatibility with the binder resin that the copolymer may come present in an extremely small (or large) quantity in the vicinity of toner surfaces to bring out no sufficient effect of incorporating the resin. Hence, it is more preferable that the proportion of total content of the styrene unit, sulfonic acid ester unit and sulfonic acid unit to other unit(s) satisfies:

Units represented by the above formulas (1) to (3):other unit(s)=100:0 to 85:15, and particularly preferably 98:2 to 88:12;

on the basis of the number of units (molar basis).

To make microadjustment control of physical properties of the above copolymer, the copolymer may preferably have a unit represented by the following formula (4) (an acrylate unit or a methacrylate unit). The presence of the acrylate unit or methacrylate unit enables microadjustment control of the compatibility with the binder resin and wax, and also makes it easy to control glass transition point. This also enables improvement in solubility in solvents, and further can enhance random copolymerization properties to promote uniform distribution of the sulfonic acid ester unit in the molecule.

(4)

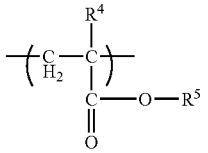

wherein $R^4$ represents a hydrogen atom or a methyl group, and $R^5$ represents a hydrocarbon group which may have a substituent. The substituent may be a halogen atom, a hydroxyl group or an amino group.

In the above formula (4), $R^5$ may preferably be a hydrocarbon group having 1 to 10 carbon atoms.

There are no particular limitations on how to synthesize the above copolymer. As a preferable method, it may be a method in which part of the sulfonic acid group or sulfonic acid salt group of a copolymer obtained by copolymerizing monomer components containing styrene and a monomer represented by the following formula (5) is esterified with an alkyl group having 1 to 4 carbon atoms.

(5)

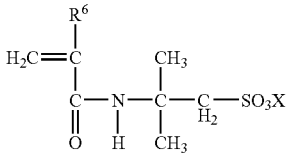

wherein $R^6$ represents a hydrogen atom, a methyl group or an ethyl group, and X represents a hydrogen atom or a mixture of a hydrogen and a monovalent cation.

In the above method, where the acrylate unit or methacrylate unit should be introduced, any desired acrylate monomer or methacrylate monomer may be copolymerized with styrene and the monomer represented by the above formula (5). The mixing ratio of these monomers may be changed to control the unit ratio. In particular, the monomer represented by the above formula (5) and other monomer(s) may preferably be copolymerized in the range of from 3.0:97.0 to 15.0:85.0 on the basis of the number of units, and may more preferably be copolymerized in the range of from 3.5:97.5 to 12.0:88.0.

As methods for the above esterification, known methods may be used. Stated specifically, available are a method in which sulfonic acid is chlorinated and thereafter allowed to react with an alcohol, a method in which methyl esterifying agent such as dimethylsulfuric acid, trimethylsilyldiazomethane or trimethyl phosphate is used, and a method in which an orthoformate is used. However, as a result of extensive studies made by the present inventors, what is best as a method for the esterification in the present invention has been found to be the method in which an orthoformate is used. This method enables easy esterification of the sulfonic acid by allowing an orthoformate having the desired alkyl group to react with the copolymer, under relatively mild conditions, and enables easy control of the proportion of esterification by selecting reaction temperature, reaction time, the amount of the orthoformate, the amount of a solvent, and so forth.

The orthoformate used in the present invention may specifically include trimethyl orthoformate, triethyl orthoformate, tri-n-propyl orthoformate, tri-iso-propyl orthoformate, tri-n-butyl orthoformate, tri-sec-butyl orthoformate, tri-tert-butyl orthoformate, and mixtures of any of these.

The acrylate monomer or methacrylate monomer is a monomer represented by the following formula (7).

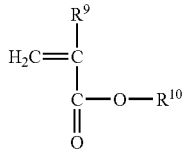

(7)

wherein R9 represents a hydrogen atom or a methyl group, and R10 represents a hydrocarbon group which may have a substituent. The substituent may be a halogen atom, a hydroxyl group or an amino group.

In the above formula (7), R10 may preferably be a hydrocarbon group having 1 to 10 carbon atoms.

To give specific examples of the compound having the above structure, it may include α-methylene aliphatic monocarboxylates such as methyl methacrylate, ethyl methacrylate, propyl methacrylate, n-octyl methacrylate, dodecyl methacrylate, 2-ethylhexyl methacrylate, stearyl methacrylate, phenyl methacrylate, 2-hydroxyethyl methacrylate, dimethylaminoethyl methacrylate and diethylaminoethyl methacrylate; acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, phenyl acrylate and 2-hydroxyethyl acrylate.

With the above copolymer, other monomer may also be copolymerized as a constituent, taking account of solubility in the solvent, compatibility with the binder resin, compatibility with a wax, and so forth. The monomer which may be copolymerized may be selected from known monomers as desired. To give specific examples, it may include ethylene unsaturated monoolefins such as ethylene, propylene, butylene and isobutylene; unsaturated polyenes such as butadiene and isoprene; vinyl esters such as vinyl acetate, vinyl propionate and vinyl benzoate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid derivatives such as acrylonitrile, methacrylonitrile and acrylamide.

As polymerization initiators usable in copolymerizing the monomer components described above, various ones may be used, such as peroxide type polymerization initiators and azo type polymerization initiators.

The peroxide type polymerization initiators which may be used may include, as organic types, peroxy esters, peroxydicarbonates, dialkyl peroxides, peroxyketals, ketone peroxides, hydroperoxides and diacyl peroxides, and, as inorganic types, may include persulfates and hydrogen peroxide. Stated specifically, such initiators may include peroxy esters such as t-butyl peroxyacetate, t-butyl peroxylaurate, t-butyl peroxypivarate, t-butyl peroxy-2-ethyl hexanoate, t-butyl peroxyisobutyrate, t-butyl peroxyneodecanoate, t-hexyl peroxyacetate, t-hexyl peroxylaurate, t-hexyl peroxypivarate, t-hexyl peroxy-2-ethyl hexanoate, t-hexyl peroxyisobutyrate, t-hexyl peroxyneodecanoate, t-butyl peroxybenzoate, α,α'-bis(neodecanoylperoxy)diisopropylbenzene, cumyl peroxyneodecanoate, 1,1,3,3-tetramethylbutyl peroxy-2-ethylhexanoate, 1,1,3,3-tetramethylbutyl peroxyneodecanoate, 1-cyclohexyl-1-methyethyl peroxyneodecanoate, 2,5-dimethyethyl-2,5-bis(2-ethylhexanoylperoxy)hexane, 1-cyclohexyl-1-methylethyl peroxy-2-ethylhexanoate, t-hexyl peroxyisopropyl monocarbonate, t-butyl peroxyisopropyl monocarbonate, t-butyl peroxy-2-hexyl monocarbonate, t-hexyl peroxybonzoate, 2,5-dimethyethyl-2,5-bis(benzoylperoxy)hexane, t-butyl peroxy-m-toluoyl benzoate, bis(t-butylperoxy)isophthalate, t-butyl peroxymaleic acid, t-butyl peroxy-3,5,5-trimethyl hexanoate, 2,5-dimethylethyl-2,5-bis(m-toluoylperoxy)hexane; diacyl peroxides such as benzoyl peroxide, lauroyl peroxide and isobutylyl peroxide; peroxydicarbonates such as diisopropyl peroxydicarbonate and bis(4-t-butylcyclohexyl)peroxydicarbonate; peroxyketals such as 1,1-di-t-butylperoxycyclohexane, 1,1-di-t-hexylperoxycyclohexane, 1,1-di-t-butylperoxy-3,3,5-trimethylcyclohexane and 2,2-di-t-butylperoxybutane; dialkyl peroxides such as di-t-butyl peroxide, dicumyl peroxide and di-t-butylcumyl peroxide; and others such as butyl peroxyallylmonocarbonate. Also, the azo type polymerization initiators which may be used may be exemplified by 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile, and azobisisobutyronitrile.

Incidentally, two or more types of any of these polymerization initiators may optionally simultaneously be used.

The polymerization initiator used here may preferably be in an amount of from 0.1 to 20 parts by mass based on 100 parts by mass of the monomers.

As the polymerization process, any of processes such as solution polymerization, suspension polymerization, emulsion polymerization, dispersion polymerization, precipitation polymerization and bulk polymerization may be used without any particular limitations.

As described previously, it is preferable to control the glass transition point (Tg) of the above copolymer in order to bring out its effect without damaging the fixing performance of the toner. As Tg measured with a differential scanning calorimeter (DSC), the copolymer may preferably have the Tg in the range of from 45° C. to 90° C., and more preferably in the range of from 50° C. to 85° C.

In the present invention, if the above copolymer has too small molecular weight, it tends to contaminate members such as a sleeve and a carrier, and, in addition thereto, may adversely affect the charge characteristics of the sulfonic acid unit and sulfonic acid ester unit. If on the other hand it has too large molecular weight, not only there is a possibility of damaging the fixing performance of the toner, but also the state of presence of the copolymer in toner may be so unstable as to bring out no stable charge characteristics. From the foregoing viewpoint, the above copolymer may preferably have a weight average molecular weight Mw of from 2,000 to 200,000. As a more preferable range, it may have a weight average molecular weight Mw of from 5,000 to 100,000, and still more preferably from 5,000 to 50,000.

From the viewpoint of charge characteristics and fixing performance, it is preferable for the above copolymer to have a narrow molecular weight distribution. As a preferable range of the molecular weight distribution, in weight average molecular weight Mw and number weight average molecular weight Mn, the value of Mw/Mn may be from 1.0 to 6.0, and more preferably from 1.0 to 4.0.

The molecular weight and molecular weight distribution of the above copolymer are those measured by gel permeation chromatography (GPC) and calculated in terms of polystyrene. However, in those containing a sulfonic acid group as in the copolymer in the present invention, the column elution rate depends also on the quantity of the sulfonic acid group, and hence it does not follow that accurate molecular weight and molecular weight distribution can be measured. Accordingly, it is necessary to ready a sample in which the sulfonic acid group has beforehand been capped. For such capping, methyl esterification is preferred, and a commercially available methyl esterifying agent may be used. Stated specifically, a method of treatment with trimethylsilyldiazomethane is available.

Incidentally, the measurement of molecular weight by GPC may be made in the following way.

A solution prepared by adding the copolymer to THF (tetrahydrofuran) and left at room temperature for 24 hours is filtered with a solvent-resistant membrane filter of 0.2 μm in pore diameter to make up a sample solution, and the measurement is made under the following conditions. Incidentally, in making up the sample, the amount of THF is so adjusted that the copolymer is in a concentration of from 0.4 to 0.6% by mass.

Apparatus: High-speed GPC HLC8120 GPC (manufactured by Tosoh Corporation).

Columns: Combination of seven columns, Shodex KF-801, KF-802, KF-803, KF-804, KF-805, KF-806 and KF-807 (available from Showa Denko K.K.).

Eluent: Tetrahydrofuran.

Flow rate: 1.0 ml/min.

Oven temperature: 40.0° C.

Amount of sample injected: 0.10 ml.

To calculate the molecular weight of the sample, a molecular weight calibration curve is used which is prepared using a standard polystyrene resin (TSK Standard Polystyrene F-850, F-450, F-288, F-128, F-80, F-40, F-20, F-10, F-4, F-2, F-1, A-5000, A-2500, A-1000, A-500, available from Tosoh Corporation).

In order to make adaptation to a toner production process, improve compatibility with the binder resin, and further localize the copolymer at the vicinity of toner particle surfaces when toner particles are produced in an aqueous medium, it is preferable for the above copolymer to have a specific acid value. However, if it has too high acid value, it may inhibit the charge characteristics of the sulfonic acid ester unit, undesirably. The above copolymer may preferably have the acid value in the range of from 1 to 40 mgKOH/g, and more preferably from 5 to 30 mgKOH/g.

Incidentally, the acid value in the present invention is determined in the following way.

Basic operation is made according to JIS K 0070.

(1) A crushed product of a sample is precisely weighed in an amount of from 0.5 to 2.0 g, and the mass of the sample is represented by W (g).

(2) The sample is put in a 300 ml beaker, and 150 ml of a toluene/ethanol (4/1) mixed solvent is added thereto to dissolve the sample.

(3) Using an ethanol solution of 0.1 mol/l of KOH, titration is made by means of a potentiometric titrator. (For example, automatic titration may be utilized which is made using a potentiometric titrator AT-400, WIN WORKSTATION, and an ABP-410 motor burette, manufactured by Kyoto Electronics Manufacturing Co., Ltd.).

(4) The amount of the KOH solution used here is represented by S (ml). A blank is measured at the same time, and the amount of the KOH solution used in the blank is represented by B (ml).

(5) The acid value is calculated according to the following expression. Letter symbol f is the factor of KOH.

$$\text{Acid value (mgKOH/g)}=\{(S-B)\times f\times 5.61\}/W.$$

The toner of the present invention brings out its effect in virtue of the incorporation of the above copolymer, the amount of which, however, is not particularly limited. As a preferable range, the copolymer may preferably be in an amount of from 0.1 to 20 parts by mass, and more preferably from 0.3 to 10 parts by mass, based on 100 parts by mass of the binder resin.

There are no particular limitations on the binder resin used in the toner of the present invention. It may include, e.g., styrene resins, acrylic resins, methacrylic resins, styrene-acrylic resins, styrene-methacrylic resins, polyethylene resins, polyethylene-vinyl acetate resins, vinyl acetate resins, polybutadiene resins, phenol resins, polyurethane resins, polybutyral resins and polyester resins. Of these, styrene resins, acrylic resins, methacrylic resins, styrene-acrylic resins, styrene-methacrylic resins and polyester resins are desirable in view of toner characteristics.

The toner of the present invention has a THF-soluble resin component which may preferably have peak molecular weight in the range of from 3,000 to 80,000 as measured by GPC. If it is smaller than 3,000, a problem may arise in charging performance. If it is larger than 80,000, the toner may be made to have low-temperature fixing performance with difficulty. Incidentally, the peak molecular weight may be measured by the same method as the method of measuring the molecular weight of the copolymer as described previously.

The toner of the present invention may preferably contain a wax. By incorporating a wax in toner, a toner having a superior fixing performance can be obtained, which has superior low-temperature fixing performance and anti-offset performance and also can give fixed images having superior surface smoothness.

In the case when the wax is incorporated in toner, the wax melted at the time of fixing acts as a release agent between a transfer material and a fixing member in virtue of its surface tension, to not only improve anti-offset performance greatly, but also accelerate the melting of the toner at the time of fixing to improve the low-temperature fixing performance. In order to effectively bring out such action of the toner, the melt main peak (melting point) of wax is very important. More specifically, in regard to the fixing performance of toners, what is important is the temperature of melt main peak seen at the time of heating, in a toner DSC curve obtained by measurement with a differential scanning calorimeter. If this temperature of melt main peak is too high, the release action is not brought out at the time of low-temperature fixing, so that the toner not only may have no sufficient anti-offset performance but also tends to be inferior in regard to the low-temperature fixing performance as well. If on the other hand it is too low, the toner may inevitably have too low melt viscosity, and hence the release action is not brought out on the high-temperature side, so that the toner may have no sufficient anti-offset performance to cause even a phenomenon that the transfer material winds around or sticks to a fixing member. For the reasons as stated above, a preferable range of the temperature of melt main peak seen at the time of heating, in the toner DSC curve is from 45° C. to 130° C., more preferably from 50° C. to 110° C., and still more preferably from 50° C. to 90° C.

The wax used in the toner of the present invention may preferably be in a content ranging from 0.5 to 30 parts by mass based on 100 parts by mass of the binder resin. If it is in a content of less than 0.5 parts by mass, the toner may enjoy no sufficient improvement effect on the anti-offset performance. If it is in a content of more than 30 parts by mass, the toner may have a low long-term storage stability, and also the wax may make poor the dispersibility of other toner materials. Besides, the wax comes present in the vicinity of toner surfaces in so large quantity that it may inhibit the charge characteristics that feature the present invention, or cause a lowering of the fluidity of toner and a lowering of image characteristics.

As the wax usable in the toner of the present invention, it may be selected from those having the melt main peak within the range as shown above, and there are no particular limitations thereon. Stated specifically, it may include petroleum waxes such as paraffin wax, microcrystalline wax and petrolatum, and derivatives thereof; montan wax and derivatives thereof; hydrocarbon waxes obtained by Fischer-Tropsch synthesis, and derivatives thereof; polyolefin waxes typified by polyethylene wax, and derivatives thereof; and naturally occurring waxes such as carnauba wax and candelilla wax, and derivatives thereof. The derivatives include oxides, block copolymers with vinyl monomers, and graft modified products. It may further include higher aliphatic alcohols, fatty acids such as stearic acid and palmitic acid, or compounds thereof, acid amide waxes, ester waxes, ketones, hardened caster oil and derivatives thereof, vegetable waxes, and animal waxes.

To make up a toner having a superior fixing performance as stated above, it is preferable for the toner to have a softening point temperature Ts of from 80 to 135° C., and more preferably from 85 to 120° C., as calculated from a flow tester curve of the toner. A toner having too high softening temperature may have superior anti-offset performance, but its fixing temperature is obliged to be set high, and also the surface smoothness at image areas may vastly lower to make no high color reproducibility expectable. On the other hand, a toner having too low softening temperature may have so weak anti-blocking properties as to make no high anti-offset performance expectable even though it contains the wax. Further, when fixed at a high temperature, toner molten components may greatly penetrate into paper at the time of fixing, conversely resulting in damage of the surface smoothness of fixed images.

As stated above, to make up the toner having a superior fixing performance, it is preferable to control the softening temperature calculated from a flow tester curve of the toner, and, in addition thereto, it is preferable to also control glass transition point of the toner. That is, if the toner has too high a glass transition point, the low-temperature fixing performance is not achievable. As the glass transition point of the toner is made lower, the melting temperature lowers. However, if it is too low, the toner may have a poor storage stability to not only bring about a possibility of causing a blocking phenomenon, but also inevitably cause melt adhesion of toner to the interior of a developing assembly especially in a high-temperature environment, and the toner particles may melt-adhere to one another to cause a lowering, of fluidity. Moreover, the charging performance lowers consequently, to cause toner scatter at the time of development and cause fog. For the reasons as stated above, the toner may preferably have the glass transition point in the range of from 45 to 75° C., and more preferably from 50 to 70° C., as determined from a DSC curve of the toner.

In the present invention, the melt main peak, softening point temperature and glass transition point of the wax or toner may be measured with, e.g., a differential scanning calorimeter (DSC; M-DSC, manufactured by TA. Instruments Japan Ltd.). As a measuring method, about 6 mg of a sample is precisely weighed and put in an aluminum pan and an empty aluminum pan is set as a reference pan. Measurement is made in an atmosphere of nitrogen, at a modulation amplitude of plus-minus 0.6° C. and at a frequency of 1/minute. The glass transition point is determined by the middle-point method from a reversing heat flow curve drawn at the time of heating. The melt main peak is determined from the heat flow curve obtained in the above measurement.

The toner of the present invention may also be incorporated with a charge control agent in order to support triboelectric charge characteristics of the toner. In this case, charge control agents which have a high charging speed and also can maintain a constant charge quantity stably are preferred. In the case when the toner is produced by polymerization, it is particularly preferable to use charge control agents having no polymerization inhibitory action. Stated specifically, preferred are, as negative charge control agents, metal compounds of salicylic acid, alkylsalicylic acids, dialkylsalicylic acids, naphthoic acid, dicarboxylic acids and so forth; polymer type compounds having sulfonic acid or carboxylic acid in the side chain; as well as boron compounds, urea compounds, silicon compounds, and carixarene. As positive charge control agents, they may include quaternary ammonium salts, polymer type compounds having such a quaternary ammonium salt in the side chain, guanidine compounds and imidazole compounds.

The toner of the present invention contains a colorant. As black colorants, usable are carbon black, magnetic materials, and colorants toned in black by using yellow, magenta and cyan colorants shown below.

As yellow colorants, compounds typified by condensation azo compounds, isoindolinone compounds, anthraquinone compounds, azo metal complex methine compounds and allylamide compounds are used, which are of pigment types. Stated specifically, C.I. Pigment Yellow 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 155, 166, 168, 169, 177, 179, 180, 181, 183, 185, 191:1, 191, 192, 193 and 199 are preferably used. As dye types, the yellow colorant may include, e.g., C.I. Solvent Yellow 33, 56, 79, 82, 93, 112, 162 and 163; and C.I. Disperse Yellow 42, 64, 201 and 211.

As magenta colorants, condensation azo compounds, diketopyrrolopyrrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 122, 146, 166, 169, 177, 184, 185, 202, 206, 220, 221, 238, 254 and 269, and C.I. Pigment Violet 19 are particularly preferred.

As cyan colorants, copper phthalocyanine compounds and derivatives thereof, anthraquinone compounds and basic dye lake compounds may be used. Stated specifically, C.I. Pigment Blue 1, 7, 15:1, 15:2, 15:3, 15:4, 60, 62 and 66 may particularly preferably be used. A cyan toner is obtainable by incorporating any of these cyan colorants into the toner.

Any of these colorants may be used alone, in the form of a mixture, or further in the state of a solid solution. In the present invention, the colorants are selected taking account of hue angle, chroma, brightness, weatherability, transparency on OHP sheets and dispersibility in toner base particles. The colorant may preferably be added in an amount of from 1 to 20 parts by mass based on 100 parts by mass of the binder resin.

The toner of the present invention may also be further incorporated with a magnetic material so that it can be used as a magnetic toner. In this case, the magnetic material may also serve as a colorant. In the present invention, the magnetic material may include iron oxides such as magnetite, hematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

The magnetic material used in the present invention may preferably be a surface-modified magnetic material, and, when used in a polymerization toner produced by polymer solution suspension or by suspension polymerization, may more preferably be those having been subjected to hydrophobic treatment with a surface modifier which is a substance having no polymerization inhibitory action. Such a surface modifier may include, e.g., silane coupling agents and titanium coupling agents.

These magnetic materials may preferably be those having an average particle diameter of 2.0 μm or less, and preferably from 0.1 to 0.5 μm. As quantity in which the magnetic material is incorporated in the toner particles, it may preferably be incorporated in an amount of from 20 to 200 parts by mass, and particularly preferably from 40 to 150 parts by mass, based on 100 parts by mass of the binder resin.

The magnetic material may preferably be a magnetic material having a coercive force (Hc) of from 1.59 to 23.9 kA/m (20 to 300 oersteds), a saturation magnetization (σs) of from 50 to 200 emu/g and a residual magnetization (σr) of from 2 to 20 emu/g as magnetic properties under application of 796 kA/m (10 kilooersteds).

In the toner of the present invention, in order to develop finer latent image dots faithfully to achieve a high image quality, the toner may preferably have a weight average particle diameter (D4) of from 3.0 to 9.0 μm, and more preferably from 4.0 to 6.9 μm. In a toner having a weight average particle diameter of less than 3.0 μm, transfer residual toner may remain on the photosensitive member in a large quantity because of a lowering of transfer efficiency to make it difficult to keep the photosensitive member from its abrasion and the toner from its melt adhesion. Further, such a toner tends to cause fog and a lowering of transfer performance because the toner has a large particle surface area as a whole and, in addition thereto, has low fluidity and agitation properties, tending to cause abrasion and melt adhesion and besides non-uniformity or the like of images. Also, in the case of a toner having a weight average particle diameter of more than 9.0 μm, spots around line images tend to occur in character and line images, making it difficult to attain a high resolution and tending to cause a lowering of dot reproducibility.

The weight average particle diameter and particle size distribution of the toner may be measured by a method making use of Coulter Counter Model TA-II or Coulter Multisizer (manufactured by Coulter Electronics, Inc.). In Examples of the present invention, Coulter Multisizer (manufactured by Coulter Electronics, Inc.) is used. An interface (manufactured by Nikkaki Bios Co.) that outputs number distribution and volume distribution and a personal computer PC9801 (manufactured by NEC.) are connected. As an electrolytic solution, an aqueous 1% NaCl solution is prepared using first-grade sodium chloride. For example, ISOTON R-II (available from Coulter Scientific Japan Co.) may be used. As a method for measurement, from 0.1 to 5 ml of a surface active agent, preferably an alkylbenzene sulfonate, is added as a dispersant to from 100 to 150 ml of the above aqueous electrolytic solution, and from 2 to 20 mg of a sample to be measured is further added. The electrolytic solution in which the sample has been suspended is subjected to dispersion treatment for about 1 minute to about 3 minutes in an ultrasonic dispersion machine. The volume distribution and number distribution are calculated by measuring the volume and number of toner particles of 2.0 μm or more in particle diameter by means of the above Coulter Multisizer, using an aperture of 100 μm as its aperture. From the values obtained, the weight average particle diameter (D4) is determined.

The toner of the present invention may preferably have an average circularity of 0.955 or more, and particularly preferably an average circularity of 0.970 or more. Toners having a high average circularity have very good transfer performance. This is considered due to the fact that the area of contact between the toner particles and the photosensitive member can be so small as to lower the attraction force of toner particles on photosensitive member that is ascribable to mirror force or van der Waals force.

The average circularity referred to in the present invention is used as a simple method for expressing the shape of particles quantitatively. In the present invention, the shape of particles is measured with a flow type particle image analyzer FPIA-1000, manufactured by Sysmex Corporation. The circularity of each particle measured is determined according to the following expression. As also further shown in the following expression, the value obtained when the sum total of circularities of all particles measured is divided by the number of all particles is defined to be the average circularity.

$$\text{Circularity} = \frac{\text{Circumferential length of a circle with the same projected area of a particle}}{\text{Circumferential length of particle projected image}}.$$

$$\text{Average circularity } \bar{c} = \sum_{i=1}^{m} (c_i / m)$$

Incidentally, the measuring device "FPIA-1000" used in the present invention employs a calculation method in which, in calculating the circularity of each particle and thereafter calculating the average circularity, circularities in the range of 0.4 to 1.00 are divided into 61 ranges at intervals of 0.01 in such ranges as 0.40 or more to less than 0.41, 0.41 or more to less than 0.42, . . . , 0.99 or more to less than 1.00, and 1.00, and the average circularity is calculated using the center values and frequencies of divided points. Between the values of the average circularity calculated by this calculation method and the values of the average circularity calculated by the above calculation equation which uses the circularity of each particle directly, there is only a very small accidental error, which is at a level that is substantially negligible. Accordingly, in the present invention, such a calculation method in which the concept of the calculation equation which uses the circularity of each particle directly is utilized and is partly modified may be used, for the reasons of handling data, e.g., making the calculation time short and making the operational equation for calculation simple.

The summary of measurement is described in a catalog of FPIA-1000 (an issue of June, 1995), published by Sysmex Corporation, and in an operation manual of the measuring instrument and Japanese Patent Application. Laid-open No. H08-136439, and is as follows:

10 ml of ion-exchanged water from which impurity solid matter or the like has been removed is made ready in a container, and a surface active agent, preferably an alkylbenzenesulfonate, is added thereto as a dispersant. Thereafter, a sample for measurement is further added in an amount of 0.02 g, and is uniformly dispersed. As a means for dispersing it, an ultrasonic dispersion machine UH-50 Model (manufactured by SMT Co., Ltd.) is used, fitted with a titanium alloy tip as an oscillator, and dispersion treatment is carried out for 5 minutes to prepare a fluid dispersion for measurement. In that case, the fluid dispersion is appropriately cooled so that its temperature may not come to 40° C. or more. Then, the concentration of the fluid dispersion is again so adjusted as to be 3,000 to 10,000 particles/μl.

The sample fluid dispersion again adjusted is passed through channels (extending along the flow direction) of a flat transparent flow cell (thickness: about 200 μm). A strobe and a CCD (charge-coupled device) camera are fitted at positions opposite to each other with respect to the flow cell so as to form a light path that passes crosswise with respect to the thickness of the flow cell. During the flowing of the sample fluid dispersion, the dispersion is irradiated with strobe light at intervals of 1/30 seconds to obtain an image of the particles flowing through the cell, so that a photograph of each particle is taken as a two-dimensional image having a certain range parallel to the flow cell. From the area of the two-dimensional image of each particle, the diameter of a circle having the same area is calculated as the circle-equivalent diameter. The circularity of each particle is calculated from the projected area of the two-dimensional image of each particle and the circumferential length of the projected image according to the above equation for calculating the circularity. The above measurement is made on at least 1,000 toners, and the average circularity is determined using the data obtained.

The "circularity" referred to in the present invention is an index showing the degree of particle surface unevenness of the toner particles. It is indicated as 1.00 when the toner particles are perfectly spherical. The more complicate the toner particle shape is, the smaller the value of circularity is.

In general, toners having an amorphous toner particle shape have a low charging uniformity at hills or dales of the toner particle surfaces. Moreover, because of being amorphous, the area of contact between the photosensitive member (electrostatic latent image bearing member) and the toner comes large, resulting in a high toner attraction force, to cause an increase in transfer residual toner.

As methods for producing the toner of the present invention, known production methods may be used without any particularly limitations. Stated specifically, available are the method disclosed in Japanese Patent Publication No. S36-010231 and Japanese Patent Application Laid-open Nos. S59-053856 and S59-061842, in which toner particles are directly produced by suspension polymerization; a method in which toner particles are produced by emulsion polymerization as typified by soap-free polymerization; a method in which toner particles are produced by interfacial polymerization like that in the production of microcapsules; making into toner particles by coacervation; a method in which toner particles are produced by association polymerization where at least one kind of fine particles is agglomerated to obtain toner particles with desired particle diameter, as disclosed in Japanese Patent Applications Laid-open No. S62-106473 and No. S63-186253; a method in which toner particles are produced by dispersion polymerization characterized by monodispersion; a method of obtaining toner particles by a polymer dissolution (melting) suspension process in which necessary resins are dissolved in a water-insoluble organic solvent and thereafter made into toner particles in water; also a method of obtaining toner particles by a pulverization process in which toner components are kneaded and uniformly dispersed by using a pressure kneader, an extruder, a media dispersion machine or the like, followed by cooling, and the kneaded product cooled is made to collide against a target in a mechanical fashion or in jet streams so as to be finely pulverized to have the desired toner particle diameter, further followed by the step of classification to make particle size distribution sharp to produce the toner particles; and further a method in which the toner particles obtained by the pulverization process are put to spherical treatment by heating or the like in a solvent.

In particular, what brings out the effect of the present invention more remarkably is the polymer dissolution (melting) suspension process or the suspension polymerization process. The reason therefor is that the copolymer described above can effectively be made present in the vicinity of toner particle surfaces in the step of effecting granulation in an aqueous medium (a granulation step). Each process is described below.

In the method of producing toner particles by the polymer dissolution (melting) suspension process, first, the binder resin, the copolymer and the colorant are dissolved, mixed or dispersed in an organic medium, or the copolymer and the colorant are dissolved, mixed or dispersed in a resin brought into a molten state by heat. Further, together with the wax and other additives optionally used, the solution or dispersion obtained is uniformly dissolved, mixed or dispersed by means of a stirrer or the like to prepare a liquid mixture for the formation of toner particles. In that case, what has been prepared by beforehand melt-kneading the colorant, the wax and other additives may be added. The liquid mixture thus obtained is added to a dispersion medium (preferably an aqueous medium) containing a dispersion stabilizer, and the former is dispersed and suspended until it comes into particles having toner particle diameters (a granulation step), by using as a stirrer a high-speed stirrer or using a high-speed dispersion machine such as an ultrasonic dispersion machine. Then, where an organic solvent is used to dissolve the binder, the organic solvent is removed by heating or evacuation, and further a solvent such as methanol, ethanol, 1-propanol, t-butyl alcohol or acetone is added to remove the organic solvent completely, thus the toner particles can be obtained.

In the method of producing toner particles by the suspension polymerization process, first, the colorant is uniformly dissolved, mixed or dispersed by means of a stirrer or the like in polymerizable monomers constituting the binder resin. Especially when the colorant is a pigment, it is preferable to make treatment by using a dispersion machine to make up a pigment-dispersed paste. This paste is uniformly dissolved, mixed or dispersed by means of a stirrer or the like together with the polymerizable monomer, the copolymer and the polymerization initiator, as well as the wax and other additives optionally used, to prepare a monomer composition. The monomer composition thus obtained is added to a dispersion medium (preferably an aqueous medium) containing a dispersion stabilizer, and the former is finely dispersed until it comes into particles having toner particle diameters (a granulation step), by using as a stirrer a high-speed stirrer or using a high-speed dispersion machine such as an ultrasonic dispersion machine. Then, the monomer composition finely dispersed in the granulation step is allowed to undergo polymerization reaction by light or heat, thus the toner particles can be obtained.

The organic medium usable in the polymer dissolution (melting) suspension process may be selected in accordance with the toner binder, and is not particularly limited. Stated specifically, it may be selected from ether alcohols such as methyl cellosolve, cellosolve, isopropyl cellosolve, butyl cellosolve, and diethylene glycol monobutyl ether; ketones such as acetone, methyl ethyl ketone and methyl isobutyl ketone; esters such as ethyl acetate, butyl acetate, ethyl propionate and cellosolve acetate; hydrocarbons such as hexane, octane, petroleum ether, cyclohexane, benzene, toluene and xylene; halogenated hydrocarbons such as trichloroethylene, dichloromethane and chloroform; ethers such as ethyl ether, dimethyl glycol, trioxan tetrahydrofuran; acetals such as methylal and diethylaceatal; and sulfur- or nitrogen-containing organic compounds such as nitropropene, nitrobenzene and dimethyl sulfoxide.

As a method for dispersing a pigment composition in the organic medium, any known method may be used. For example, the resin and a pigment dispersant are optionally dissolved in the organic medium, and then pigment powder is slowly added thereto with stirring, to make it well fittable to the solvent. Further, a mechanical shear force is applied by using a dispersion machine such as a ball mill, a paint shaker, a dissolver, an attritor, a sand mill or a high-speed mill, whereby the pigment can stably finely be dispersed, i.e., can be dispersed in the form of uniform fine particles.

There are no particular limitations on the binder resin used in the polymer dissolution (melting) suspension process. It may include, e.g., styrene resins, acrylic resins, methacrylic resins, styrene-acrylic resins, styrene-methacrylic resins, polyethylene resins, polyethylene-vinyl acetate resins, vinyl acetate resins, polybutadiene resins, phenol resins, polyurethane resins, polybutyral resins and polyester resins. Of these, styrene resins, acrylic resins, methacrylic resins, styrene-acrylic resins, styrene-methacrylic resins and polyester resins are desirable in view of toner characteristics.

The polymerizable monomer preferably usable in the suspension polymerization process is an addition polymerization type monomer or a condensation polymerization type monomer. It may preferably be the addition polymerization type monomer. Stated specifically, it may include styrene and derivatives thereof, such as styrene, o-methylstyrene, m-methylstyrene, p-methylstyrene, p-methoxystyrene, p-phenylstyrene, p-chlorostyrene, 3,4-dichlorostyrene, p-ethylstyrenee, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; ethylene unsaturated monoolefins such as ethylene, propylene, butylene and isobutylene; unsaturated polyenes such as butadiene and isoprene; vinyl halides such as vinyl chloride, vinylidene chloride, vinyl bromide and vinyl iodide; vinyl esters such as vinyl acetate, vinyl propionate and vinyl benzoate; α-methylene aliphatic monocarboxylic esters such as methyl methacrylate, ethyl methacrylate, propyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide.

The dispersion medium usable in the above production process may be selected taking account of the dispersibility of the binder resin, organic medium, monomers and copolymer in the dispersion medium, and an aqueous dispersion medium is preferred. As the aqueous dispersion medium, it may be selected from water; alcohols such as methyl alcohol, ethyl alcohol, modified ethyl alcohol, isopropyl alcohol, n-butyl alcohol, isobutyl alcohol, tert-butyl alcohol, sec-butyl alcohol, tert-amyl alcohol, 3-pentanol, octyl alcohol, benzyl alcohol and cyclohexanol; ether alcohols such as methyl cellosolve, cellosolve, isopropyl cellosolve, butyl cellosolve, diethylene glycol monobutyl ether; ketones such as acetone, methyl ethyl ketone and methyl isobutyl ketone; esters such as ethyl acetate, butyl acetate, ethyl propionate and cellosolve acetate; acetals such as methylal and diethylaceatal; acids such as formic acid, acetic acid and propionic acid; and sulfur- or nitrogen-containing organic compounds such as nitropropene, nitrobenzene, dimethylamine, monoethanolamine, pyridine, dimethyl sulfoxide and dimethylformamide. It may particularly preferably be water or an alcohol. Any of these dispersion mediums may also be used in the form of a mixture of two or more types. In the dispersion medium, the liquid mixture or the monomer composition may be in a concentration of from 1 to 80% by mass, and more preferably from 10 to 65% by mass, based on the dispersion medium.

As a dispersion stabilizer usable when the aqueous dispersion medium is used, any known agent may be used. Stated specifically, it may include, as inorganic dispersants, calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. As organic compounds, it may include polyvinyl alcohol, gelatin, methyl cellulose, methyl hydroxypropyl cellulose, ethyl cellulose, carboxymethyl cellulose sodium salt, polyacrylic acid and salts thereof, and starch, any of which may be used in the state of being dispersed in an aqueous phase. The dispersion stabilizer may preferably be in a concentration of from 0.2 to 20 parts by mass 100 parts by mass of the liquid mixture or the monomer composition.

As a polymerization initiator used in producing the toner of the present invention by the suspension polymerization process, it may include known polymerization initiators. Stated specifically, those enumerated in the method of producing the above copolymer may be used.

As a chain transfer agent used in producing the toner of the present invention by the suspension polymerization process, it may include known chain transfer agents.

The toner of the present invention may preferably have an inorganic fine powder on the surfaces of toner particles.

The inorganic fine powder is externally added to toner particles in order to improve the fluidity of the toner and make the toner uniformly chargeable, and is present in the state it adheres uniformly to the toner particle surfaces.

In the present invention, it is preferable to add an inorganic fine powder having a number average primary particle diameter of from 4 nm to 80 nm. If the inorganic fine powder has a number average primary particle diameter of more than 80 nm, it is difficult to achieve a sufficient fluidity of the toner, so that the toner particles tend to be non-uniformly charged to tend to inevitably cause problems of fogging greatly, a decrease in image density, toner scatter and so forth. If the inorganic fine powder has a number average primary particle diameter of less than 4 nm, the inorganic fine powder may strongly be susceptible to agglomerate, and tends to behave not as primary particles but as agglomerates having a broad particle size distribution which are so strongly agglomerative as to break up with difficulty even by disintegration treatment, so that the agglomerates may participate in development or may scratch an image bearing member or developer carrying member to tend to cause image defects. In order for the toner particles to have more uniform charge distribution, the inorganic fine powder may preferably have a number average primary particle diameter of from 6 to 35 nm.

In the present invention, as a method for measuring the number average primary particle diameter of the inorganic fine powder, it may be measured in the following way. On a photograph of toner, taken under magnification on a scanning electron microscope, and further comparing it with a photograph of toner particles mapped with elements the inorganic fine powder contains, by an elemental analysis means such as XMA (X-ray microanalyzer) attached to the scanning electron microscope, at least 100 primary particles of the inorganic fine powder which are present in the state they adhere to or come liberated from toner particle surfaces are observed to measure their particle diameter to determine the number-average primary particle diameter.

As the inorganic fine powder used in the present invention, an inorganic fine powder selected from fine powders of silica, alumina and titania or a fine powder of any of their double oxides may be used, for example. Such a fine double oxide powder may include, e.g., fine aluminum silicate powder and fine strontium titanate powder. Also, as the fine silica powder, usable are, e.g., what is called dry-process silica or fumed silica produced by vapor phase oxidation of silicon halides and what is called wet-process silica produced from water glass or the like, either of which may be used. The dry-process silica is preferred, as having less silanol groups on the particle surfaces and interiors of the fine silica powder and leaving less production residues such as $Na_2O$ and $SO_3^{2-}$. In the dry-process silica, it is also possible to use, e.g., in its production step, other metal halide such as aluminum chloride or titanium chloride together with the silicon halide to give a composite fine powder of silica with other metal oxide. The fine silica powder includes these as well.

The inorganic fine powder having a number average primary particle diameter of from 4 nm to 80 nm may preferably be added in an amount of from 0.1 to 5.0% by mass based on the mass of the toner particles. In its addition in an amount of less than 0.1% by mass, it may insufficiently be effective. Its addition in an amount of more than 5.0% by mass may make the toner have a poor fixing performance.

The inorganic fine powder in the present invention is added in order to improve the fluidity of the toner and make the toner particles uniformly chargeable. The inorganic fine powder may be subjected to treatment such as hydrophobic treatment so as to function to, e.g., control the charge quantity of the toner and improve environmental stability. This is also a preferred embodiment.

Where the inorganic fine powder added to the magnetic toner has moistened, the toner particles may be charged in a very low quantity to tend to cause toner scatter.

As a hydrophobic treating agent with which the inorganic fine powder is hydrophobic-treated, usable are treating agents such as a silicone varnish, a modified silicone varnish of various types, a silicone oil, a modified silicone oil of various types, a silane compound, a silane coupling agent, other organic silicon compound and an organotitanium compound, any of which may be used alone or in combination to carry out the treatment.

In particular, an inorganic fine powder having been treated with the silicone oil is preferred. An inorganic fine powder having been hydrophobic-treated and, simultaneously with or after the treatment, treated with the silicone oil may be used in magnetic toner particles. This is favorable in order to maintain the charge quantity of toner particles at a high level even in a high humidity environment and to prevent toner scatter.

In order to improve cleaning performance and so forth, inorganic or organic closely spherical fine particles having a primary particle diameter of more than 30 nm (preferably having a BET specific surface area of less than 50 $m^2/g$), and more preferably a primary particle diameter of more than 50 nm (preferably having a BET specific surface area of less than 30 $m^2/g$), may further be added to the toner of the present invention. This is also one of preferred embodiments. Stated specifically, spherical silica particles, spherical polymethyl silsesquioxane particles and spherical resin particles may preferably be used, for example.

In the toner of the present invention, other additives may further be used, which may include, e.g., lubricant powders such as TEFLON (trademark of Du Pont), zinc stearate powder and polyvinylidene fluoride powder; abrasives such as cerium oxide powder, silicon carbide powder and strontium titanate powder; fluidity-providing agents such as titanium oxide powder and aluminum oxide powder; and anti-caking agents; as well as reverse-polarity organic and/or inorganic fine particles, which may also be used in a small quantity as a developability improver. These additives may also be used after hydrophobic treatment of their particle surfaces.

The toner of the present invention may be used as a one-component developer consisting of the toner only, or may also be blended with a carrier so as to be used as a two-component developer.

EXAMPLES

The present invention is specifically described below by giving Examples. The present invention is by no means limited to these Examples. In Examples, "part(s)" as so termed refers to "part(s) by mass" in all occurrences.

Production Example of Copolymer Containing Sulfonic Ester Group

Copolymers containing the sulfonic acid ester group were synthesized in the following way.

Production of Copolymer A

Into a reaction vessel provided with a stirrer, a condenser, a thermometer and a nitrogen feed pipe, 67 parts of methanol, 50 parts of toluene and 83 parts of methyl ethyl ketone were introduced, and these were refluxed in a stream of nitrogen.

Next, the following monomers were mixed together to prepare a liquid monomer mixture.

Monomer Composition and Mixing Ratio:

| | |
|---|---|
| 2-Acrylamido-2-methylpropanesulfonic acid | 6.0 parts |
| Styrene | 81.0 parts |
| 2-Ethylhexyl acrylate | 13.0 parts |

In this liquid monomer mixture, 5.0 parts of dimethyl-2,2'-azobis(2-methyl propionate) was mixed as a polymerization initiator. The mixture obtained was dropwise added with stirring, to those in the reaction vessel, and these were kept as they were for 10 hours. Thereafter, distillation was carried out to evaporate the solvents off, followed by drying at 50° C. under reduced pressure. The solid matter obtained was pulverized to obtain Copolymer A.

Production of Copolymer B

Into a reaction vessel provided with a stirrer, a condenser, a thermometer and a nitrogen feed pipe, 67 parts of methanol, 50 parts of toluene and 83 parts of methyl ethyl ketone were introduced, and these were refluxed in a stream of nitrogen.

Next, the following monomers were mixed together to prepare a liquid monomer mixture.

Monomer Composition and Mixing Ratio:

| | |
|---|---|
| 2-Methacrylamido-2-methylpropanesulfonic acid | 10.0 parts |
| Styrene | 77.0 parts |
| 2-Ethylhexyl acrylate | 13.0 parts |

In this liquid monomer mixture, 5.0 parts of dimethyl-2,2'-azobis(2-methyl propionate) was mixed as a polymerization initiator. The mixture obtained was dropwise added with stirring, to those in the reaction vessel, and these were kept as they were for 10 hours. Thereafter, distillation was carried out to evaporate the solvents off, followed by drying at 50° C. under reduced pressure. The solid matter obtained was pulverized to obtain Copolymer B.

Production of Copolymer C

Into a reaction vessel provided with a stirrer, a condenser, a thermometer and a nitrogen feed pipe, 67 parts of methanol, 50 parts of toluene and 83 parts of methyl ethyl ketone were introduced, and these were refluxed in a stream of nitrogen.

Next, the following monomers were mixed together to prepare a liquid monomer mixture.

Monomer Composition and Mixing Ratio:

| | |
|---|---|
| 2-Acrylamido-2-methylpropanesulfonic acid | 15.0 parts |
| Styrene | 72.0 parts |
| n-Butyl acrylate | 13.0 parts |

In this liquid monomer mixture, 5.0 parts of dimethyl-2,2'-azobis(2-methyl propionate) was mixed as a polymerization initiator. The mixture obtained was dropwise added with stirring, to those in the reaction vessel, and these were kept as they were for 10 hours. Thereafter, distillation was carried out to evaporate the solvents off, followed by drying at 50° C. under reduced pressure. The solid matter obtained was pulverized to obtain Copolymer C.

Production of Copolymer D

Into a reaction vessel provided with a stirrer, a condenser, a thermometer and a nitrogen feed pipe, 50 parts of methanol and 200 parts of tetrahydrofuran were introduced, and these were refluxed in a stream of nitrogen.

Next, the following monomers were mixed together to prepare a liquid monomer mixture.

Monomer Composition and Mixing Ratio:

| | |
|---|---|
| 2-Acrylamido-2-methylpropanesulfonic acid | 20.0 parts |
| Styrene | 65.0 parts |
| Methyl methacrylate | 15.0 parts |

In this liquid monomer mixture, 3.0 parts of 2,2'-azobis(2,4-dimethylvaleronitrile) was mixed as a polymerization initiator. The mixture obtained was dropwise added with stirring, to those in the reaction vessel, and these were kept as they were for 10 hours. Thereafter, distillation was carried out to evaporate the solvents off, followed by drying at 50° C. under reduced pressure. The solid matter obtained was pulverized to obtain Copolymer D.

Production of Copolymer E

Into a reaction vessel provided with a stirrer, a condenser, a thermometer and a nitrogen feed pipe, 50 parts of methanol and 200 parts of tetrahydrofuran were introduced, and these were refluxed in a stream of nitrogen.

Next, the following monomers were mixed together to prepare a liquid monomer mixture.

Monomer Composition and Mixing Ratio:

| | |
|---|---|
| 2-Acrylamido-2-methylpropanesulfonic acid | 5.0 parts |
| Styrene | 82.0 parts |
| 2-Ethylhexyl acrylate | 13.0 parts |

In this liquid monomer mixture, 3.0 parts of 2,2'-azobis(2,4-dimethylvaleronitrile) was mixed as a polymerization initiator. The mixture obtained was dropwise added with stirring, to those in the reaction vessel, and these were kept as they were for 10 hours. Thereafter, distillation was carried out to evaporate the solvents off, followed by drying at 50° C. under reduced pressure. The solid matter obtained was pulverized to obtain Copolymer E.

Production of Copolymer F

Into a reaction vessel provided with a stirrer, a condenser, a thermometer and a nitrogen feed pipe, 67 parts of methanol, 50 parts of toluene and 83 parts of methyl ethyl ketone were introduced, and these were refluxed in a stream of nitrogen.

Next, the following monomers were mixed together to prepare a liquid monomer mixture.

Monomer Composition and Mixing Ratio:

| | |
|---|---|
| 2-Acrylamido-2-methylpropanesulfonic acid | 27.0 parts |
| Styrene | 60.0 parts |
| 2-Ethylhexyl acrylate | 13.0 parts |

In this liquid monomer mixture, 5.0 parts of dimethyl-2,2'-azobis(2-methyl propionate) was mixed as a polymerization initiator. The mixture obtained was dropwise added with stirring, to those in the reaction vessel, and these were kept as they were for 10 hours. Thereafter, distillation was carried out to evaporate the solvents off, followed by drying at 50° C. under reduced pressure. The solid matter obtained was pulverized to obtain Copolymer F.

Production of Copolymer G

Into a reaction vessel provided with a stirrer, a condenser, a thermometer and a nitrogen feed pipe, 67 parts of methanol, 50 parts of toluene and 83 parts of methyl ethyl ketone were introduced, and these were refluxed in a stream of nitrogen.

Next, the following monomers were mixed together to prepare a liquid monomer mixture.

Monomer Composition and Mixing Ratio:

| | |
|---|---|
| 2-Acrylamido-2-methylpropanesulfonic acid | 10.0 parts |
| Methyl methacrylate | 90.0 parts |

In this liquid monomer mixture, 5.0 parts of dimethyl-2,2'-azobis(2-methyl propionate) was mixed as a polymerization initiator. The mixture obtained was dropwise added with stirring, to those in the reaction vessel, and these were kept as they were for 10 hours. Thereafter, distillation was carried out to evaporate the solvents off, followed by drying at 50° C. under reduced pressure. The solid matter obtained was pulverized to obtain Copolymer G.

In regard to Copolymers A to G thus produced, their molecular weight and acid value were measured by the method described previously, to obtain the results shown in Table 1. Incidentally, the molecular weight was measured using those in which all sulfonic acid groups were methylated.

Methyl Esterification of Copolymer, for Measurement of Molecular Weight:

10 g of each copolymer was put into a reaction vessel, and 350 g of chloroform and 87.5 g of methanol were added thereto to effect dissolution, followed by cooling to 0° C. To this solution, 20 ml of a 2 mol/liter trimethylsilyldiazomethane-hexane solution (available from Aldrich Chemical Co., Inc) was added, and these were stirred for 4 hours. Thereafter, distillation was carried out to evaporate the solvents off.

Further, 350 parts of toluene and 100 parts of methyl ethyl ketone were added to dissolve the polymer again, and the solvents were removed by distillation. This procedure of re-dissolution/distillation was repeatedly carried out three times, followed by drying at 50° C. under reduced pressure. The solid matter obtained was pulverized to obtain a methyl-esterified product of each copolymer.

TABLE 1

| Copolymer | Composition of copolymer | Molecular weight Mw | Molecular weight Mw/Mn | Acid value (mgKOH/g) |
|---|---|---|---|---|
| A | AMPS/St/2EHA | 24,000 | 2.23 | 28.0 |
| B | MMPS/St/2EHA | 29,200 | 2.26 | 34.4 |
| C | AMPS/St/BA | 27,600 | 2.88 | 51.9 |
| D | AMPS/St/MMA | 9,200 | 2.41 | 66.2 |
| E | AMPS/St/2EHA | 8,900 | 3.04 | 24.1 |
| F | AMPS/St/2EHA | 27,760 | 2.70 | 92.3 |
| G | AMPS/MMA | 28,460 | 2.82 | 51.3 |

AMPS: 2-acrylamido-2-methylpropanesulfonic acid
MMPS: 2-methacrylamido-2-methylpropanesulfonic acid
St: styrene
2EHA: 2-ethylhexyl acrylate
BA: n-butyl acrylate
MMA: methylmethacrylate In regard to Copolymers A to G produced as above, these were esterified in the following way.

Production of Copolymer H

Into a 3 litter reaction vessel, 400 ml of trimethyl orthoformate was introduced, and then heated to 80° C. To this, 100 g of Copolymer A was added in 5 minutes, followed by stirring for 15 hours. Thereafter, the reaction mixture was dropwise added to 9 liters of n-hexane with stirring. The mixture obtained was left for a while to allow the resin to deposit and precipitate. The supernatant was removed by decantation, and 500 ml of chloroform was added to the residue to dissolve it. This was dropwise added to 7.5 liters of n-hexane with stirring to allow the resin to deposit and precipitate. The supernatant was removed by decantation, and the residue was dried under reduced pressure. This was washed with 300 ml of methanol, and further washed with 300 ml of water. This was dried under reduced pressure to obtain Copolymer H.

Production of Copolymer I

Into a 3 litter reaction vessel, 800 ml of trimethyl orthoformate was introduced, and then heated to 80° C. To this, 100 g of Copolymer B was added in 5 minutes, followed by stirring for 15 hours. Thereafter, the reaction mixture was dropwise added to 9 liters of n-hexane with stirring. The mixture obtained was left for a while to allow the resin to deposit and precipitate. The supernatant was removed by decantation, and 500 ml of chloroform was added to the residue to dissolve it. This was dropwise added to 7.5 liters of n-hexane with stirring to allow the resin to deposit and precipitate. The supernatant was removed by decantation, and the residue was dried under reduced pressure. This was washed with 300 ml of methanol, and further washed with 300 ml of water. This was dried under reduced pressure to obtain Copolymer I.

Production of Copolymer J

Into a 3 litter reaction vessel, 800 ml of trimethyl orthoformate was introduced, and then heated to 80° C. To this, 100 g of Copolymer C was added in 5 minutes, followed by stirring for 15 hours. Thereafter, the reaction mixture was dropwise added to 9 liters of n-hexane with stirring. The mixture obtained was left for a while to allow the resin to deposit and precipitate. The supernatant was removed by decantation, and 500 ml of chloroform was added to the residue to dissolve it. This was dropwise added to 7.5 liters of n-hexane with stirring to allow the resin to deposit and precipitate. The supernatant was removed by decantation, and the residue was dried under reduced pressure. This was washed with 300 ml of methanol, and further washed with 300 ml of water. This was dried under reduced pressure to obtain Copolymer J.

Production of Copolymer K

Into a 3 litter reaction vessel, 800 ml of trimethyl orthoformate was introduced, and then heated to 40° C. To this, 100 g of Copolymer C was added in 5 minutes, followed by stirring for 2 hours. Thereafter, the reaction mixture was dropwise added to 9 liters of n-hexane with stirring. The mixture obtained was left for a while to allow the resin to deposit and precipitate. The supernatant was removed by decantation, and 500 ml of chloroform was added to the residue to dissolve it. This was dropwise added to 7.5 liters of n-hexane with stirring to allow the resin to deposit and precipitate. The supernatant was removed by decantation, and the residue was dried under reduced pressure. This was washed with 300 ml of methanol, and further washed with 300 ml of water. This was dried under reduced pressure to obtain Copolymer K.

Production of Copolymer L

Into a 3 litter reaction vessel, 1,200 ml of triethyl orthoformate was introduced, and then heated to 60° C. To this, 100 g of Copolymer D was added in 5 minutes, followed by stirring for 7 hours. Thereafter, the reaction mixture was dropwise added to 9 liters of n-hexane with stirring. The mixture obtained was left for a while to allow the resin to deposit and precipitate. The supernatant was removed by decantation, and 500 ml of chloroform was added to the residue to dissolve it. This was dropwise added to 7.5 liters of n-hexane with stirring to allow the resin to deposit and precipitate. The supernatant was removed by decantation, and the residue was dried under reduced pressure. This was washed with 300 ml of methanol, and further washed with 300 ml of water. This was dried under reduced pressure to obtain Copolymer L.

Production of Copolymer M

Into a 3 litter reaction vessel, 400 ml of trimethyl orthoformate was introduced, and then heated to 40° C. To this, 100 g of Copolymer C was added in 5 minutes, followed by stirring for 30 minutes. Thereafter, the reaction mixture was dropwise added to 9 liters of n-hexane with stirring. The mixture obtained was left for a while to allow the resin to deposit and precipitate. The supernatant was removed by decantation, and 500 ml of chloroform was added to the residue to dissolve it. This was dropwise added to 7.5 liters of n-hexane with stirring to allow the resin to deposit and precipitate. The supernatant was removed by decantation, and the residue was dried under reduced pressure. This was washed with 300 ml of methanol, and further washed with 300 ml of water. This was dried under reduced pressure to obtain Copolymer M.

Production of Copolymer N 100 g of Copolymer C was put into a 3 litter reaction vessel, and 3,500 g of chloroform and 800 g of methanol were added thereto to effect dissolution, followed by cooling to 0° C. To this solution, 75 g of a 2 mol/liter trimethylsilyldiazomethane-hexane solution (available from Aldrich Chemical Co., Inc) was added, and these were stirred for 4 hours. Thereafter, distillation was carried out to evaporate the solvents off.

Further, 2,500 parts of toluene and 1,000 parts of methyl ethyl ketone were added to dissolve the polymer again, and the solvents were removed by distillation. This procedure of re-dissolution/distillation was repeatedly carried out three times, followed by drying at 50° C. under reduced pressure. The solid matter obtained was pulverized to obtain Copolymer N.

Production of Copolymer O

Into a 3 litter reaction vessel, 400 ml of trimethyl orthoformate was introduced, and then heated to 80° C. To this, 100 g of Copolymer E was added in 5 minutes, followed by stirring for 15 hours. Thereafter, the reaction mixture was dropwise added to 9 liters of n-hexane with stirring. The mixture obtained was left for a while to allow the resin to deposit and precipitate. The supernatant was removed by decantation, and 500 ml of chloroform was added to the residue to dissolve it. This was dropwise added to 7.5 liters of n-hexane with stirring to allow the resin to deposit and precipitate. The supernatant was removed by decantation, and the residue was dried under reduced pressure. This was washed with 300 ml of methanol, and further washed with 300 ml of water. This was dried under reduced pressure to obtain Copolymer O.

Production of Copolymer P

Into a 3 litter reaction vessel, 1,200 ml of trimethyl orthoformate was introduced, and then heated to 40° C. To this, 100 g of Copolymer F was added in 5 minutes, followed by stirring for 10 hours. Thereafter, the reaction mixture was dropwise added to 9 liters of n-hexane with stirring. The mixture obtained was left for a while to allow the resin to deposit and precipitate. The supernatant was removed by decantation, and 500 ml of chloroform was added to the residue to dissolve it. This was dropwise added to 7.5 liters of n-hexane with stirring to allow the resin to deposit and precipitate. The supernatant was removed by decantation, and the residue was dried under reduced pressure. This was washed with 300 ml of methanol, and further washed with 300 ml of water. This was dried under reduced pressure to obtain Copolymer P.

Production of Copolymer Q

Into a 3 litter reaction vessel, 800 ml of trimethyl orthoformate was introduced, and then heated to 80° C. To this, 100 g of Copolymer G was added in 5 minutes, followed by stirring for 15 hours. Thereafter, the reaction mixture was dropwise added to 9 liters of n-hexane with stirring. The mixture obtained was left for a while to allow the resin to deposit and precipitate. The supernatant was removed by decantation, and 500 ml of chloroform was added to the residue to dissolve it. This was dropwise added to 7.5 liters of n-hexane with stirring to allow the resin to deposit and precipitate. The supernatant was removed by decantation, and the residue was dried under reduced pressure. This was washed with 300 ml of methanol, and further washed with 300 ml of water. This was dried under reduced pressure to obtain Copolymer Q.

As to Copolymers H to Q thus produced, the constitution of their respective units which was calculated from the results of $^{1}$H-NMR and $^{13}$C-NMR elementary analyses, and their acid value and Tg are shown in Table 2.

$^{1}$H-NMR and $^{13}$C-NMR:

FT-NMR JNM-EX400, manufactured by JEOL Ltd., (solvent used: deuterated chloroform, $CDCl_3$).

Elementary Analysis:

Elementary analysis instrument EA-1180, manufactured by Fisons Co., (C content, S content and N content were calculated).

TABLE 2

| | | Unit ratio | | | | | | | |
|---|---|---|---|---|---|---|---|---|---|
| Copolymer | Base copolymer | A Unit having sulfonic ester group | B Unit having sulfonic acid group | C Styrene unit | D Other unit | (A + B)/(C + D) | A/B | Acid value (mgKOH/g) | Tg (° C.) |
| H | A | 2.7% | 0.6% | 88.7% | 2EHA: 8.0% | 3.3/96.7 | 81.8/18.2 | 5.0 | 65.4 |
| I | B | 4.6% | 0.7% | 86.5% | 2EHA: 8.3% | 5.3/94.7 | 86.8/13.2 | 5.2 | 66.6 |
| J | C | 7.6% | 1.1% | 82.9% | BA: 8.5% | 8.7/91.3 | 87.4/12.6 | 6.3 | 69.2 |
| K | C | 5.8% | 2.9% | 82.9% | BA: 8.5% | 8.7/91.3 | 66.7/33.3 | 17.2 | 71.8 |
| L | D | 8.6% | 2.5% | 71.7% | MMA: 17.2% | 11.1/88.9 | 77.5/22.5 | 15.0 | 79.0 |
| M | C | 3.7% | 5.0% | 82.9% | BA: 8.5% | 8.7/91.3 | 43.1/56.9 | 29.0 | 73.6 |
| N | C | 8.5% | 0.2% | 82.9% | BA: 8.5% | 8.7/91.3 | 98.2/1.8 | 0.9 | 68.6 |
| O | E | 2.2% | 0.5% | 89.3% | 2EHA: 8.0% | 2.7/97.3 | 80.1/19.9 | 4.8 | 64.8 |
| P | F | 14.0% | 2.8% | 74.2% | 2EHA: 9.1% | 16.8/83.2 | 83.5/16.5 | 15.2 | 71.1 |
| Q | G | 6.9% | 1.0% | — | MMA: 92.1% | 7.9/92.1 | 87.3/12.7 | 6.2 | 80.3 |

2EHA: 2-ethylhexyl acrylate
BA: n-butyl acrylate
MMA: methylmethacrylate

Example 1

Preparation of Pigment Dispersed Paste

| | |
|---|---|
| Styrene | 80 parts |
| Copper phthalocyanine (C.I. Pigment Blue 15:3) | 6.5 parts |

The above materials were well premixed in a container. Thereafter, the mixture obtained was, as it was kept at 20° C. or less, subjected to dispersion for about 4 hours by means of a bead mill to prepare a pigment dispersed paste.

Production of Toner Particles:

In 1,150 parts of ion-exchanged water, 390 parts of an aqueous 0.1 mol/liter $Na_3PO_4$ solution was introduced, followed by heating to 60° C. and thereafter stirring at 11,000 rpm using a TK-type homomixer (manufactured by Tokushu kika Kogyo Co., Ltd.). To the resultant mixture, 58 parts of an aqueous 1.0 mol/liter $CaCl_2$ solution was slowly added to obtain a dispersion medium containing $Ca_3(PO_4)_2$.

| | |
|---|---|
| Above pigment dispersed paste | 86.5 parts |
| Styrene | 2.0 parts |
| n-Butyl acrylate | 18.0 parts |
| Ester wax (chief component: $C_{19}H_{39}COOC_{20}H_{41}$; melting point: 68.6° C.) | 13.0 parts |
| Saturated polyester resin (terephthalic acid-propylene oxide modified bisphenol A copolymer; acid value: 15 mgKOH/g; Mw: 12,000; Tg: 68° C.) | 5.0 parts |
| Copolymer H | 2.0 parts |

These were heated to 60° C. and dissolved or dispersed to prepare a monomer mixture. Further, while keeping the monomer mixture at 60° C., 3.0 parts of 2,2'-azobis(2,4-dimethylvaleronitrile) as a polymerization initiator was added and dissolved to prepare a monomer composition. This monomer composition was introduced into the above dispersion medium, which was prepared in a 2 liter flask of the homomixer. These were stirred at 60° C. and at 10,000 rpm for 20 minutes, using the TK-type homomixer, which was set in an atmosphere of nitrogen, to granulate the monomer composition. Thereafter, with stirring by means of a paddle stirring blade, the reaction was carried out at 60° C. for 5 hours, followed by stirring at 80° C. for 5 hours, where the polymerization was completed. The reaction system was cooled to room temperature, and thereafter hydrochloric acid was added thereto to dissolve the $Ca_3(PO_4)_2$, followed by filtration, washing with water and then drying to obtain polymer particles. The polymer particles obtained were further classified to obtain toner particles.

Production of Toner:

To 100 parts of the toner particles obtained, 1 part of a hydrophobic fine silica powder having a number average primary particle diameter of 9 nm and a BET specific surface area of 180 $m^2/g$, having been surface-treated with hexamethyldisilazane and thereafter treated with silicone oil, was mixed and externally added by means of Henschel mixer (manufactured by Mitsui Miike Engineering Corporation) to obtain Toner 1.

Example 2

Toner 2 was obtained in the same manner as in Example 1 except that Copolymer I was used in place of Copolymer H.

Example 3

Toner 3 was obtained in the same manner as in Example 1 except that Copolymer J was used in an amount of 1.5 parts in place of Copolymer H used in an amount of 2.0.

Example 4

| Preparation of pigment dispersed paste: | |
|---|---|
| Styrene | 78.0 parts |
| Copper phthalocyanine (C.I. Pigment Blue 15:3) | 6.5 parts |

The above materials were well premixed in a container. Thereafter, the mixture obtained was, as it was kept at 20° C. or less, subjected to dispersion for about 4 hours by means of a bead mill to prepare a pigment dispersed paste.

Production of Toner Particles and Toner:

In 1,200 parts of ion-exchanged water, 350 parts of an aqueous 0.1 mol/liter $Na_3PO_4$ solution was introduced, followed by heating to 60° C. and thereafter stirring at 11,000 rpm using a TK-type homomixer (manufactured by Tokushu Kika Kogyo Co., Ltd.). To the resultant mixture, 52 parts of an aqueous 1.0 mol/liter $CaCl_2$ solution was slowly added to obtain a dispersion medium containing $Ca_3(PO_4)_2$.

| | |
|---|---|
| Above pigment dispersed paste | 84.5 parts |
| n-Butyl acrylate | 22.0 parts |
| Fischer-Tropsch wax (Mw: 1,850; Mw/Mn: 1.27; melting point: 78.6° C.) | 10.0 parts |
| Saturated polyester resin (terephthalic acid-propylene oxide modified bisphenol A copolymer; acid value: 15 mgKOH/g; Mw: 12,000; Tg: 68° C.) | 5.0 parts |
| Copolymer K | 1.0 part |

These were heated to 60° C. and dissolved or dispersed to prepare a monomer mixture. Further, while keeping the monomer mixture at 60° C., 5.0 parts of 2,2'-azobis(2,4-dimethylvaleronitrile) as a polymerization initiator was added and dissolved to prepare a monomer composition. This monomer composition was introduced into the above dispersion medium, which was prepared in a 2 liter flask of the homomixer. These were stirred at 60° C. and at 10,000 rpm for 20 minutes, using the TK-type homomixer, which was set in an atmosphere of nitrogen, to granulate the monomer composition. Thereafter, with stirring by means of a paddle stirring blade, the reaction was carried out at 60° C. for 5 hours, followed by stirring at 80° C. for 5 hours, where the polymerization was completed. The reaction system was cooled to room temperature, and thereafter hydrochloric acid was added thereto to dissolve the $Ca_3(PO_4)_2$, followed by filtration, washing with water and then drying to obtain polymer particles. The polymer particles obtained were further classified to obtain toner particles. Further, in the same manner as in Example 1, the hydrophobic fine silica powder was externally added to the toner particles to obtain Toner 4.

Example 5

Toner 5 was obtained in the same manner as in Example 4 except that Copolymer L was used in place of Copolymer K.

Example 6

Preparation of Toner Composition Liquid Mixture

| | |
|---|---|
| Copolymer polyester resin of bisphenol-A propylene oxide addition product/bisphenol-A ethylene oxide addition product/terephthalic acid derivative (Tg: 62° C.; softening point: 102° C.; Mw: 16,000) | 100.0 parts |
| Copper phthalocyanine (C.I. Pigment Blue 15:3) | 5.0 parts |
| Fischer-Tropsch wax (Mw: 1,850; Mw/Mn: 1.27; melting point: 78.6° C.) | 8.0 parts |
| Copolymer K | 1.5 parts |
| Ethyl acetate | 100.0 parts |

The above materials were well premixed in a container. Thereafter, the mixture obtained was, as it was kept at 20° C. or less, subjected to dispersion for about 4 hours by means of a bead mill to prepare a toner composition liquid mixture.

Production of Toner Particles and Toner:

In 240 parts of ion-exchanged water, 78 parts of an aqueous 0.1 mol/liter $Na_3PO_4$ solution was introduced, followed by heating to 60° C. and thereafter stirring at 11,000 rpm using a TK-type homomixer (manufactured by Tokushu Kika Kogyo Co., Ltd.). To the resultant mixture, 12 parts of an aqueous 1.0 mol/liter $CaCl_2$ solution was slowly added to obtain a dispersion medium containing $Ca_3(PO_4)_2$. Further, 1.0 part of carboxymethyl cellulose (trade name: CELLOGEN BS-H, available from Daiichi Kogyo Seiyaku Co., Ltd.) was added, followed by stirring for 10 minutes.

The above dispersion medium, which was prepared in a flask of the above homomixer, was controlled at 30° C. and stirred, into which 180 parts of the above toner composition liquid mixture, which was controlled at 30° C., was introduced. These were stirred for 1 minute, and thereafter the stirring was stopped to obtain a toner composition dispersed suspension. The toner composition dispersed suspension was stirred, during which, at a constant temperature of 40° C., the gaseous phase on the suspension surface was forcedly renewed by means of a local exhaust system. This state was kept for 17 hours and the solvent was removed. The reaction system was cooled to room temperature, and thereafter hydrochloric acid was added thereto to dissolve the $Ca_3(PO_4)_2$, followed by filtration, washing with water and then drying to obtain resin particles. The resin particles obtained were further classified to obtain toner particles. Further, in the same manner as in Example 1, the hydrophobic fine silica powder was externally added to the toner particles to obtain Toner 6.

Example 7

Toner 7 was obtained in the same manner as in Example 6 except that Copolymer L was used in place of Copolymer K.

Comparative Example 1

Toner 8 was obtained in the same manner as in Example 1 except that Copolymer M was used in an amount of 1.0 part in place of Copolymer H used in an amount of 2.0 parts.

Comparative Example 2

Toner 9 was obtained in the same manner as in Example 1 except that Copolymer N was used in place of Copolymer H.

Comparative Example 3

Toner 10 was obtained in the same manner as in Example 4 except that Copolymer O was used in an amount of 1.5 parts in place of Copolymer K used in an amount of 1.0 part.

Comparative Example 4

Toner 11 was obtained in the same manner as in Example 4 except that Copolymer P was used in an amount of 1.5 parts in place of Copolymer K used in an amount of 1.0 part.

Comparative Example 5

Toner 12 was obtained in the same manner as in Example 4 except that Copolymer Q was used in an amount of 1.5 parts in place of Copolymer K used in an amount of 1.0 part.

In regard to the above Toners 1 to 12, their weight average particle diameter and average circularity were measured by the methods described previously. Further, their softening temperature was measured with a flow tester, and DSC values were also measured. Results obtained are shown in Table 3.

TABLE 3

| | | | Weight | | | DSC | |
|---|---|---|---|---|---|---|---|
| | Toner No. | Copolymer | average particle diameter (μm) | Average circularity | Flow tester softening temperature (° C.) | Tg (° C.) | Melt main peak (° C.) |
| Example: | | | | | | | |
| 1 | Toner 1 | H: 2.0 parts | 6.26 | 0.982 | 91.2 | 58.4 | 68.8 |
| 2 | Toner 2 | I: 2.0 parts | 6.24 | 0.978 | 95.9 | 58.0 | 68.7 |
| 3 | Toner 3 | J: 1.5 parts | 6.22 | 0.981 | 97.0 | 58.3 | 68.9 |
| 4 | Toner 4 | K: 1.0 part | 5.83 | 0.986 | 93.6 | 57.3 | 73.9 |
| 5 | Toner 5 | L: 1.0 part | 5.97 | 0.988 | 98.0 | 58.9 | 73.8 |
| 6 | Toner 6 | K: 1.5 parts | 6.45 | 0.976 | 101.2 | 63.8 | 74.3 |
| 7 | Toner 7 | L: 1.5 parts | 6.05 | 0.980 | 108.5 | 65.6 | 74.2 |
| Comparative Example: | | | | | | | |
| 1 | Toner 8 | M: 1.0 part | 7.92 | 0.971 | 97.2 | 58.6 | 68.6 |
| 2 | Toner 9 | N: 2.0 parts | 7.75 | 0.970 | 96.9 | 58.5 | 68.5 |
| 3 | Toner 10 | O: 1.5 parts | 6.32 | 0.980 | 93.9 | 57.6 | 74.3 |
| 4 | Toner 11 | P: 1.5 parts | 7.81 | 0.972 | 98.3 | 59.0 | 74.2 |
| 5 | Toner 12 | Q: 1.5 parts | 8.43 | 0.970 | 98.1 | 60.1 | 73.9 |

As shown in Table 3, in Toners 8, 9, 11 and 12 of Comparative Examples 1, 2, 4 and 5, respectively, the toners had a relatively large average particle diameter. In particular, in those of Comparative Examples 1 and 5, coarse powder considered due to a low monomer solubility of Copolymers M and Q was seen in a large quantity, and agglomerates were also seen in a large number. Also, in Comparative Examples 2 and 4, both coarse powder and fine powder were present in a large quantity, showing a very broad particle size distribution.

As to Toners 1 to 12 of the above Examples 1 to 7 and Comparative Examples 1 to 5, fixing performance was tested and image reproduction was evaluated in the following way. Results obtained are shown in Table 4.

Fixing Performance Test Method:

Each toner and a ferrite carrier (volume average particle diameter Dv: 42 μm) surface-coated with silicone resin were so blended that the toner was in a concentration of 6% by mass to prepare a two-component developer. Using an altered machine of a commercially available full-color digital copying machine (CLC700, manufactured by CANON INC.), unfixed toner images (0.6 mg/cm$^2$) were formed on a transfer sheet (basis weight: 80 g/m$^2$). A fixing unit detached from a commercially available full-color laser beam printer (LBP-2020, manufactured by CANON INC.) was so altered that its fixing temperature was controllable. Using this printer, the fixing of unfixed images was tested. In a normal-temperature and normal-humidity environment (23.5° C., 60% RH), setting its process speed at 180 mm/s and changing the preset temperature within the range of from 120° C. to 220° C. with an interval of 5° C., the toner images (unfixed images) were fixed at every temperature. The temperature at which any low-temperature offset came not to be visually seen to occur was regarded as the low-temperature side start point of the anti-offset performance. Temperature lower by 5° C. than the temperature at which high-temperature offset was visually seen to occur or the temperature at which an image receiving sheet came wound around a fixing roller was regarded as the high-temperature side end point.

The fixed images obtained were also rubbed with Silbon paper to which a load of 50 g/cm$^2$ was kept applied. The fixing temperature at which the rate of decrease in density before and after the rubbing came to 5% or less was regarded as the low-temperature side start point in the evaluation of fixing performance. The point at which a gloss maximum value came out was regarded as the high-temperature side end point. Where the high-temperature offset or the wind-around of the image receiving sheet occurred, the temperature at which it occurred was regarded as the high-temperature side end point.

The gloss of fixed images was measured with a gloss measuring machine MICRO-TRI-Gloss (manufactured by Gardner Co.) and at a measuring angle of 60 degrees.

Image Reproduction Test Method:

Using a commercially available full-color laser beam printer (LBP-2040, manufactured by CANON INC.) and while optionally replenishing the toner successively, images were reproduced on 5,000 sheets in a normal-temperature and normal-humidity environment (23.5° C., 60% RH) and at a print speed of 16 sheets/minute (A4 size) in a monochromatic mode. Image density and, at the same time, toner charge quantity on the toner carrying member were measured.

TABLE 4

| | Fixing test | | | | | Image reproduction test | | | |
|---|---|---|---|---|---|---|---|---|---|
| | Anti-offset performance | | Fixing performance | | | Charge quantity | | Image density | |
| | Low-temperature side start point (° C.) | High-temperature side end point (° C.) | Fixing start point (° C.) | High-temperature side end point (° C.) | Maximum gloss value | Initial stage (mC/kg) | After 5,000 sheets (mC/kg) | Initial stage | After 5,000 sheets |
| Example: | | | | | | | | | |
| 1 | 130 | 200 | 130 | 180 | 15.3 | −34.5 | −34.9 | 1.48 | 1.46 |
| 2 | 135 | 200 | 135 | 180 | 14.9 | −38.2 | −38.6 | 1.49 | 1.47 |
| 3 | 130 | 200 | 135 | 185 | 15.8 | −44.2 | −43.9 | 1.51 | 1.48 |
| 4 | 130 | 205 | 130 | 185 | 16.5 | −41.5 | −42.1 | 1.53 | 1.50 |
| 5 | 135 | 210 | 135 | 185 | 15.0 | −39.8 | −40.4 | 1.50 | 1.48 |
| 6 | 140 | 210 | 140 | 185 | 14.6 | −41.0 | −40.7 | 1.48 | 1.47 |
| 7 | 140 | 210 | 145 | 185 | 14.1 | −37.5 | −36.6 | 1.49 | 1.47 |
| Comparative Example: | | | | | | | | | |
| 1 | 130 | 200 | 135 | 180 | 14.8 | −19.2 | −32.7 | 1.15 | 1.43 |
| 2 | 135 | 200 | 135 | 180 | 14.7 | −18.5 | −33.5 | 1.13 | 1.40 |
| 3 | 130 | 175 | 130 | 170 | 15.4 | −29.3 | −28.9 | 1.43 | 1.40 |
| 4 | 140 | 185 | 140 | 180 | 15.5 | −46.7 | −47.5 | 1.38 | 1.34 |
| 5 | 130 | 185 | 140 | 175 | 14.6 | −29.6 | −29.1 | 1.20 | 1.02 |

As is clear from the results shown in Table 4, the toners of Examples 1 to 7 according to the present invention (Toners 1 to 7) showed good results in respect of anti-offset performance and low-temperature fixing performance in the fixing test, also causing no sheet wind-around or the like, and were seen to have a sufficient fixing temperature range. Also, in the image reproduction test as well, the toners had good charge characteristics from the initial stage, which were ascertained to be maintainable even after the 5,000-sheet printing. As the result, the image density was also stable at good values throughout the running.

On the other hand, in Comparative Examples 1 and 2 (Toners 8 and 9), the results of the image reproduction test were that the charge quantity was low (the rising of charging was slow) at the initial stage and that the image density was low at the initial stage. Also, in Comparative Examples 3

(Toner 10), the results were that the charge quantity was low and also the image density was low. In Toner 11 of Comparative Example 4, the rubbing with Silbon paper resulted in a great lowering of image density when the fixing temperature was 130 to 140° C., resulting in a somewhat narrow fixing range. Also, although the charge quantity was high and was stable also after the running, the transfer performance was so poor as to result in a low image density. In Comparative Example 5 (Toner 12), the rubbing with Silbon paper resulted in a great lowering of image density when the fixing temperature was 130 to 140° C., and also the sheet wind-around occurred at 175° C. or more. As the result, compared with the fixing range of 55° C. that was achieved in Example 4, the fixing range was as narrow as 35° C. In the image reproduction test as well, the charge quantity and the image density resulted in low values.

Example 8

The following materials were well mixed using Henschel mixer (FM-75 Type, manufactured by Mitsui Miike Engineering Corporation). Thereafter, the mixture obtained was kneaded by means of a twin-screw kneader (PCM-30 Type, manufactured by Ikegai Corp.) set to a temperature of 130° C.

| | |
|---|---|
| Styrene-butyl acrylate copolymer (Tg: 58° C.; Mn: 10,000; Mw: 200,000) | 95.0 parts |
| Copolymer K | 5.0 parts |
| Magnetic iron oxide (average particle diameter: 0.18 μm) | 100.0 parts |
| Fischer-Tropsch wax (Mw: 1,850; Mw/Mn: 1.27; melting point: 78.6° C.) | 5.0 parts |

The kneaded product obtained was cooled, and then crushed by means of a hammer mill to a size of 1 mm or less. Then, the crushed product obtained was finely pulverized by means of a fine grinding mill employing an air jet system. The finely pulverized product obtained was classified to obtain toner particles. Further, in the same manner as in Example 1, the hydrophobic fine silica powder was externally added to the toner particles to obtain Toner 13.

Toner 13 thus obtained had a weight average particle diameter of 6.78 μm, an average circularity of 0.960, a flow tester softening temperature of 98.5° C., and further, in DSC, a Tg of 57.0° C. and a melt main peak at 74.0° C.

Image Reproduction Test Method:

Using a commercially available laser beam printer (LBP-930, manufactured by CANON INC.) and while optionally replenishing the toner successively, images were reproduced on 10,000 sheets in a normal-temperature and normal-humidity environment (23.5° C., 60% RH). Image density and, at the same time, toner charge quantity on the toner carrying member were measured.

As the result, the image density was stable at 1.47 to 1.50 from the initial stage up to after running, providing good images. Also, the charge quantity was −32.1 mC/kg at the initial stage, whereas it was −31.6 mC/kg after running, showing a good stability.

This application claims priority from Japanese Patent Application No. 2005-094567 filed on Mar. 29, 2005, which is hereby incorporated by reference herein.

The invention claimed is:

1. A charge control resin characterized by containing a copolymer which comprises, as at least partial structures thereof, all units represented by the following formulas (1) to (3);

in said copolymer, the total content of the units represented by the following formulas (1) and (2) being, on the basis of the number of units, in a proportion of:

Units represented by the following formulas (1) and (2): other unit(s)=3:97 to 15:85; and in said copolymer, the content of the unit represented by the following formula (1) and that of the unit represented by the following formula (2) being, on the basis of the number of units, in a proportion of:

Unit represented by the following formula (1): unit represented by the following formula (2)=50:50 to 95:5:

(1)

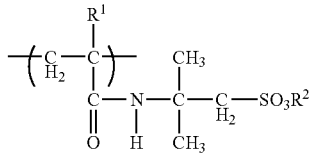

wherein $R^1$ represents a hydrogen atom, a methyl group or an ethyl group; and $R^2$ represents an alkyl group having 1 to 4 carbon atoms;

(2)

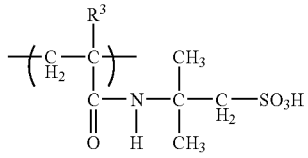

wherein $R^3$ represents a hydrogen atom, a methyl group or an ethyl group; and (3)

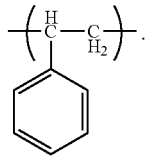

2. The charge control resin according to claim 1, wherein, in the unit represented by the above formula (1), $R^1$ is a hydrogen atom and $R^2$ is a methyl group.

3. The charge control resin according to claim 1 or 2, wherein said copolymer further comprises, as a partial structure thereof, a unit represented by the following formula (4):

(4)

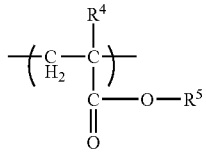

wherein $R^4$ represents a hydrogen atom or a methyl group, and $R^5$ represents a hydrocarbon group which may have a substituent; the substituent being a functional group selected from the group consisting of a halogen atom, a hydroxyl group and an amino group.

4. The charge control resin according to claim 1, wherein said copolymer is a copolymer obtained by esterifying part of the sulfonic acid group or sulfonic acid salt group of a copolymer obtained by copolymerizing at least styrene and a monomer represented by the following formula (5), with a hydrocarbon having 1 to 4 carbon atoms:

(5)

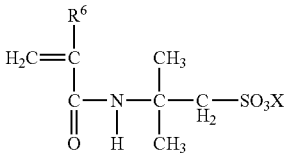

wherein $R^6$ represents a hydrogen atom, a methyl group or an ethyl group, and X represents a hydrogen atom or a mixture of a hydrogen and a monovalent cation.

5. The charge control resin according to claim 4, wherein said copolymer is a copolymer obtained by esterifying part of the sulfonic acid group or sulfonic acid salt group of a copolymer obtained by copolymerizing at least styrene and a monomer represented by the above formula (5), with an orthoformate.

6. The charge control resin according to claim 4, wherein the styrene and the monomer represented by the above formula (5) are in a copolymerization ratio ranging from 99.9:0.1 to 60.0:40.0 on the basis of the number of units.

7. The charge control resin according to claim 1, wherein said copolymer has glass transition point in the range of from 45 to 90° C. in a DSC curve determined by measurement with a differential scanning calorimeter.

8. The charge control resin according to claim 1, wherein said copolymer has weight average molecular weight in the range of from 2,000 to 200,000 as calculated by gel permeation chromatography of the copolymer.

9. The charge control resin according to claim 1, wherein, in weight average molecular weight Mw and number average molecular weight Mn as calculated by gel permeation chromatography of said copolymer, the value of Mw/Mn is in the range of from 1.0 to 6.0.

10. The charge control resin according to claim 1, wherein said copolymer has an acid value of from 1 to 40 mgKOH/g.

11. A toner which comprises toner particles containing at least a binder resin, a colorant and a charge control resin, characterized in that said charge control resin comprises a copolymer which comprises, as at least partial structures thereof, all units represented by the following formulas (1) to (3);

in said copolymer, the total content of the units represented by the following formulas (1) and (2) being, on the basis of the number of units, in a proportion of:

Units represented by the following formulas (1) and (2): other unit(s)=3:97 to 15:85; and in said copolymer, the content of the unit represented by the following formula (1) and that of the unit represented by the following formula (2) being, on the basis of the number of units, in a proportion of:

Unit represented by the following formula (1): unit represented by the following formula (2)=50:50 to 95:5:

(1)

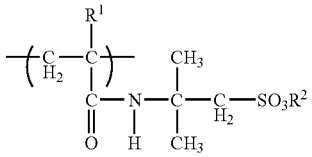

wherein $R^1$ represents a hydrogen atom, a methyl group or an ethyl group; and $R^2$ represents an alkyl group having 1 to 4 carbon atoms;

(2)

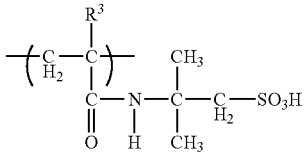

wherein $R^3$ represents a hydrogen atom, a methyl group or an ethyl group; and (3)

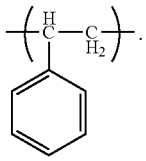

12. The toner according to claim 11, which contains a wax, and has a melt peak in the range of from 45 to 130° C. at the time of heating, in a DSC curve of the toner, prepared by measurement with a differential scanning calorimeter.

13. The toner according to claim 11, which contains said wax in an amount of from 0.5 to 30 parts by mass based on 100 parts by mass of the binder resin.

14. The toner according to claim 11, which has a softening point of from 80 to 135° C. as measured with a flow tester.

15. The toner according to claim 11, which has a glass transition point in the range of from 45 to 70° C. in a DSC curve of the toner, determined by measurement with a differential scanning calorimeter.

16. The toner according to claim 11, which has a weight average particle diameter D4 of from 3.0 to 9.0 μm.

17. The toner according to claim 11, which has an average circularity of 0.955 or more.

18. The toner according to claim 11, wherein said charge control resin is in a content of from 0.1 to 20 parts by mass based on 100 parts by mass of the binder resin.

19. The toner according to claim 11, which has an inorganic fine powder on the surfaces of said toner particles.

20. The toner according to claim 19, wherein said inorganic fine powder has a number average primary particle diameter of from 4 to 80 nm, and is an inorganic fine powder having been subjected to hydrophobic treatment.

21. The toner according to claim 11, wherein, in the unit represented by the above formula (1), R1 is a hydrogen atom and R2 is a methyl group.

22. The toner according to claim 11, wherein said copolymer further comprises, as a partial structure thereof, a unit represented by the following formula (4):

(4)

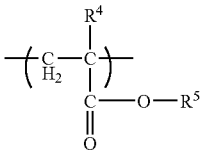

wherein $R^4$ represents a hydrogen atom or a methyl group, and $R^5$ represents a hyrdrocarbon group, and $R^5$ represents a hydrocarbon group which may have a substituent; the substituent being a functional group selected from the group consisting of a halogen atom, a hydroxyl group and an amino group.

23. The toner according to claim 11, wherein said copolymer has glass transition point in the range of 45 to 90° C. in a DSC curve prepared by measurement with a differential scanning calorimeter.

24. The toner according to claim 11, wherein said copolymer has weight average molecular weigh in the range of from 2,000 to 200,000 as calculated by gel permeation chromatography of the copolymer.

25. The toner according to claim 11, wherein, in weight average molecular weight Mw and number average molecular weigh Mn as calculated by gel permeation chromatography of said copolymer, the value of Mw/Mn is in the range of from 1.0 to 60.0.

26. The toner according to claim 11, wherein said copolymer has an acid value of from 1 to 40 mgKOH/g.

* * * * *